US005274614A

United States Patent [19]

Yamazaki

[11] Patent Number: 5,274,614

[45] Date of Patent: Dec. 28, 1993

[54] MULTI-FUNCTION ANALOG ELECTRONIC TIMEPIECE

[75] Inventor: Ko Yamazaki, Tokyo, Japan

[73] Assignee: Seiko Instruments Inc., Japan

[21] Appl. No.: 36,034

[22] Filed: Mar. 23, 1993

[30] Foreign Application Priority Data

Mar. 31, 1992 [JP] Japan ..... 4-078029

[51] Int. Cl.[5] ..... G04B 19/04; G04B 19/24; G04F 5/00

[52] U.S. Cl. ..... 368/28; 368/80; 368/157

[58] Field of Search ..... 368/28, 37, 76, 80, 368/155-159, 220, 223; 310/316-317, 322, 323

[56] References Cited

U.S. PATENT DOCUMENTS 4,525,075 6/1985 Kita ..... 368/10
5,023,853 6/1991 Kawata et al. ..... 368/230
5,043,956 8/1991 Tsukada et al. ..... 368/255
5,197,045 3/1993 Miyazawa ..... 368/157

*Primary Examiner*—Vit W. Miska
*Attorney, Agent, or Firm*—Bruce L. Adams; Van C. Wilks

[57] ABSTRACT

A high reliable multi-function analog electronic timepiece which has plurality of ultrasonic motors, or has an ultrasonic motor and a motor.

A first ultrasonic motor is provided as a driving source for driving a time indicating mechanism. The control circuit controls supplying timing of driving pulses of the first ultrasonic motor for driving a time indicating mechanism and driving pulses of the second ultrasonic motor for driving the calendar indicating mechanism. The control circuit inputs a driving pulse command signal to a piezoelectric vibrator driving circuit for providing driving pulses whose generating timing is controlled to the first ultrasonic motor.

The calendar indicating mechanism and the time indicating mechanism are operated by the operation of the second ultrasonic motor and the first ultrasonic motor.

4 Claims, 22 Drawing Sheets

MULTI-FUNCTION ANALOG ELECTRONIC TIMEPIECE

BACKGROUND OF THE INVENTION

The present invention relates to a multi-function analog electronic timepiece comprising a first indicating means driven by an ultrasonic motor and a second indicating means driven by a motor.

As shown in FIG. 15, electrical energy from a power source 1 is supplied to an electronic circuit 2. An oscillating circuit 201 which composes the electronic circuit 2 oscillates reference signals of for example, 32,768 Hz, which is further divided into 1 Hz by a frequency dividing circuit 202.

The electronic circuit 2 generates driving pulses for driving a stepping motor 3 from 1 Hz signals from the frequency dividing circuit 202 by means of a pulse generating circuit 203 and a driving circuit 204.

The stepping motor 3 of a watch comprises a coil 301 for electromagnetically converting the driving pulses from the driving circuit 204 of the electronic circuit 2 into magnetic energy, a stator 302 for directing the magnetic energy to a rotor 302 and the rotor 303 comprising an electromagnet which rotates by receiving the magnetic energy.

Since driving torque of the stepping motor 3 is small, a pinion 304 is provided to the rotor 303 to transfer rotation torque to a transmission mechanism 4 comprising a fifth gear 405 which is a decelerating gear train. Time is indicated by attaching a second hand 503 for indicating seconds to a fifth gear 404 which rotates once in one minutes among the gear train which structures the decelerating gear train in the transmission mechanism 4, a minutes hand 502 for indicating minutes to a minute gear 402 which rotates once in one hour and an hour hand 501 to an hour wheel 401 which rotates once in 12 hours. Further, date is indicated by sending once a day a date plate 701 on which dates are printed and which is engaged with a date rotating click 704 which is attached to a date rotating gear 703 which is rotated once in 24 hours by the hour wheel 401 through the intermediary of a transmission mechanism 6 comprising a decelerating gear train.

The rotor 303, fifth gear 405 and fourth gear 404 are supported by a support member 91 and are retained by a train wheel bridge 92. A third gear 403 for transferring torque from the fourth gear 404 to a branched gear 402 is supported by a date plate maintaining plate 702 which guides the date plate 701 and is retained by the train wheel bridge 92.

However, a time necessary for the date plate 701 which structures a conventional analog electronic timepiece to be sent once in one day is about 4 hours. During about 20 hours which is remainder of one day, a date jumper 705 which engages with a gear section 7011 of the date plate 701 is provided so that the date plate 701 will not rotate erroneously by shock and others during carrying the timepiece. An adjusting section 7052 of the date jumper 705 is inserted to the gear section 7011 of the date plate 701 by elastic force of a spring section 7051 of the date jumper 705 to anchor the date plate 701. During about 4 hours when the date plate 701 is switched along a change of date, the stepping motor 3 has to rotate while receiving the load of the elastic force of the spring section 7051 of the date jumper 705.

Accordingly, an enough large energy for generating rotating torque of the stepping motor 3 to overcome the elastic force of the spring section 7051 of the date jumper 705 is necessary for the driving pulses from the electronic circuit 2 to the stepping motor 3. There has been a problem that much power is consumed and a life of a battery 11 is shortened by continuously supplying enough large energy for generating rotating torque of the stepping motor 3 to overcome the elastic force of the spring section 7051 of the date jumper 705 for about 20 hours during which the date plate 701 is not switched.

The date rotating gear 703 is rotated by rotation of the stepping motor 3 through the intermediary of a date rotating intermediate gear 601 in correcting the date plate 701 to an arbitrary date. Beside the mechanism for switching the date plate 701, a manual rotation is transferred to a date correcting gear 803 through the intermediary of a cluch wheel 802 from a stem 801 by manually rotating the stem 801. A mechanism for correcting the date plate 701 to an arbitrary date by engaging the date correcting gear 803 with the date plate 701 is also provided.

During when the date plate 701 is switched by means of the date rotating gear 703, the gear section 7011 of the date plate 701 is normally moving from a position 7011 anchored by the date jumper 705. Now the gear section 7011 of the date plate 701 is at a position 7012, and at this time, the date plate 701 is tried to be corrected to an arbitrary date by the date correcting gear 803 which is engaged with the date plate 701. Then the date correcting gear 803 and a gear section 7012 of the date plate 701 sometimes thrust each other. The date correcting gear 803 or the gear section 7012 of the date plate 701 might be broken if the date of the date plate 701 is forcibly changed to the arbitrary date.

In order to solve these problems, some analog electronic timepiece excludes the date jumper 705 by providing a stepping motor 32 for rotating only a date plate 711 on which dates are printed as shown in FIGS. 20, 21 and 22.

The stepping motor 32 for rotating only the date plate 701 comprises a coil 321, a stator 322 and a rotor 323. The rotor 323 is further provided with a pinion for transmitting rotation torque to a transmission mechanism 61 for transmitting torque to a calendar indicating mechanism 71. The provision of the stepping motor 32 obviates a large energy for generating rotation torque of the stepping motor 3 for overcoming the elastic force of the spring section 7051 of the date jumper 705 to be continuously supplied during about 20 hours when the date plate 701 is not switched.

When a date of the date plate 701 is arbitrary corrected, a coil 311, stator 312 and rotor 313 for inputting date plate correcting input signal to a control circuit 215 of the electronic circuit 2 are structured by a button 811.

The stepping motor 31 has the rotor 313. The rotor 313 is provided with a pinion 314 for transmitting rotation torque to the transmission mechanism 4 for transmitting the torque to the time indicating mechanism 5. A driving circuit 214 generates driving pulses of the stepping motor 32 for rotating only the date plate 711, beside the stepping motor 31. When the date plate correcting command signal is transmitted to the driving circuit 214, the stepping motor 32 rotates to correct to an arbitrary date.

However, since the torque which is generated by the stepping motor 32 is very small, a gear train having a large deceleration ratio has to be provided beside the gear train 4 for driving the hands. These has been a problem that the transmission mechanism 61 comprising the stepping motor 32, date rotating intermediate gear 611 and date rotating gear 612 is necessary even though the date correcting gear 803 has been obviated.

Further, since the stepping motor 31 and the stepping motor 32 are electromagnetic mechanism, they are weak to strong magnetic field from outside. The stepping motor 31 and the stepping motor 32 have to be separated by a distance "L" so that magnetic fields generated by the stepping motor 31 and the stepping motor 32, respectively, will not influence each other. Accordingly, there has been a problem that since the distance "L" is not negligible distance within a size of a small timepiece, it unavoidably enlarges the analog electronic timepiece.

SUMMARY OF THE INVENTION

It is an object of the present invention to solve the aformentioned prior art problems by providing a thin type and high reliable multi-function analog electronic timepiece.

In order to solve the aforementioned problems, according to the present invention, the analog electronic timepiece comprises a power source, a source oscillator, an ultrasonic motor driving circuit for outputting pulses of predetermined frequency for driving an vibration generating means, the vibration generating means for inducing vibration by electrostrictive effect of a piezoelectric element in accordance to the output signal from the ultrasonic motor driving circuit, a pressurizing means for pressurizing the vibration generating means and a rotating means by a predetermined pressure, the rotating means which performs rotation motion by vibration of a vibrator, a first indicating means which operates by rotation of the rotating means, a motor driving circuit for outputting output signal for driving a motor, the motor which operates in accordance to the output signal from the motor driving circuit and a second indicating means which is operated by the motor.

In the analog electronic timepiece of the present invention, the ultrasonic motor driving circuit outputs pulses of predetermined frequency for driving the vibration generating means. The vibration generating means induces vibration by electrostrictive effect of a piezoelectric element in accordance to the output signal from the ultrasonic motor driving circuit. The pressurizing means pressurizes the vibration generating means and the rotating means by a predetermined pressure. The rotating means performs rotation motion by vibration of the vibrator. When the first indicating means is operated by rotation of the rotating means, the motor driving circuit outputs the output signal for driving the motor.

The motor operates in accordance to the output signal from the motor driving circuit. The second indicating means is operated by the motor. Accordingly, a multi-function analog electronic timepiece having high reliability may be provided.

DETAILED DESCRIPTION OF THE PREFERRED EMBODIMENTS

Figure 1:
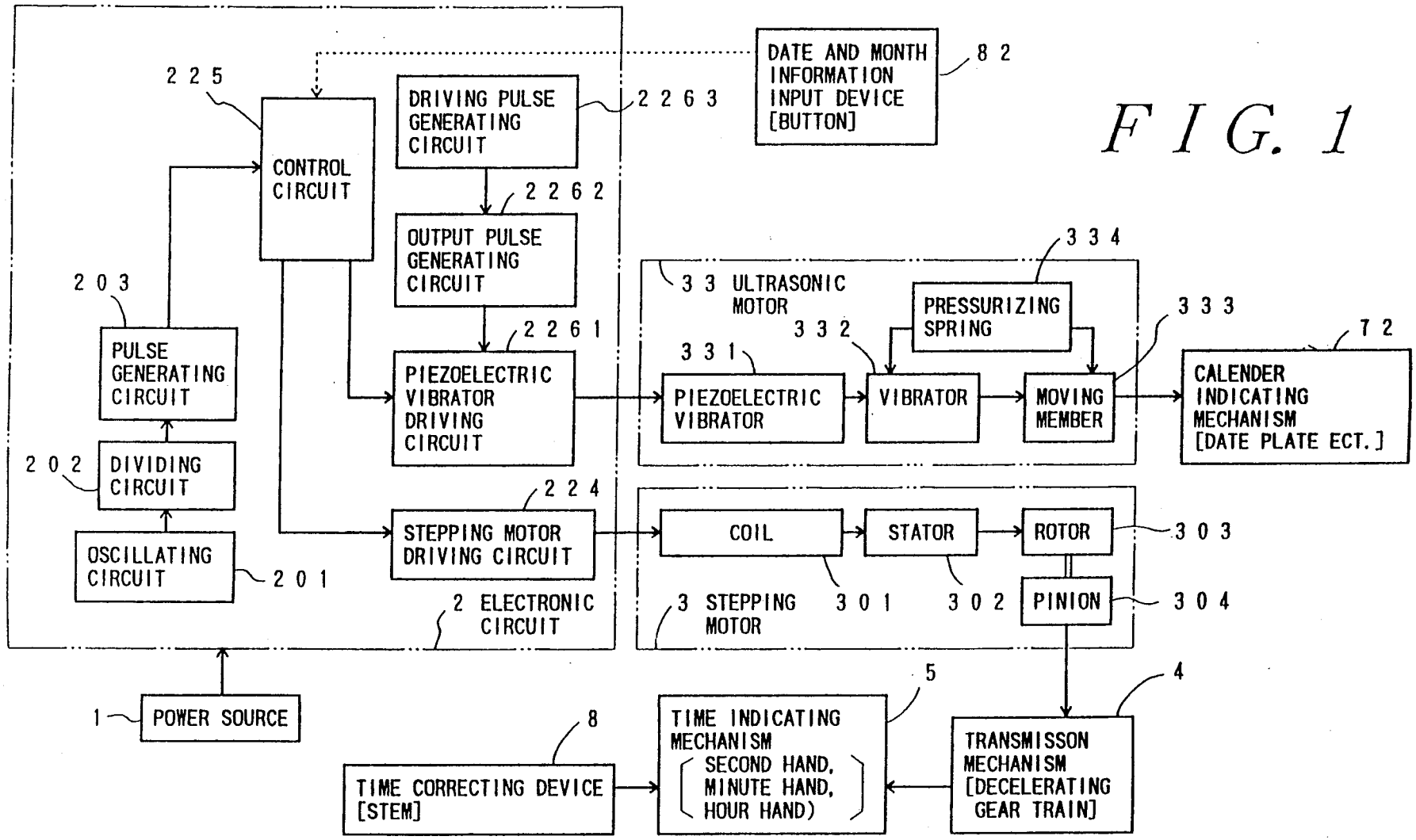
FIG. 1 is a block diagram illustrating a first embodiment of an analog electronic timepiece of the present invention.

Referring now to the drawings, preferred embodiments of the present invention will be explained.

Figure 2:
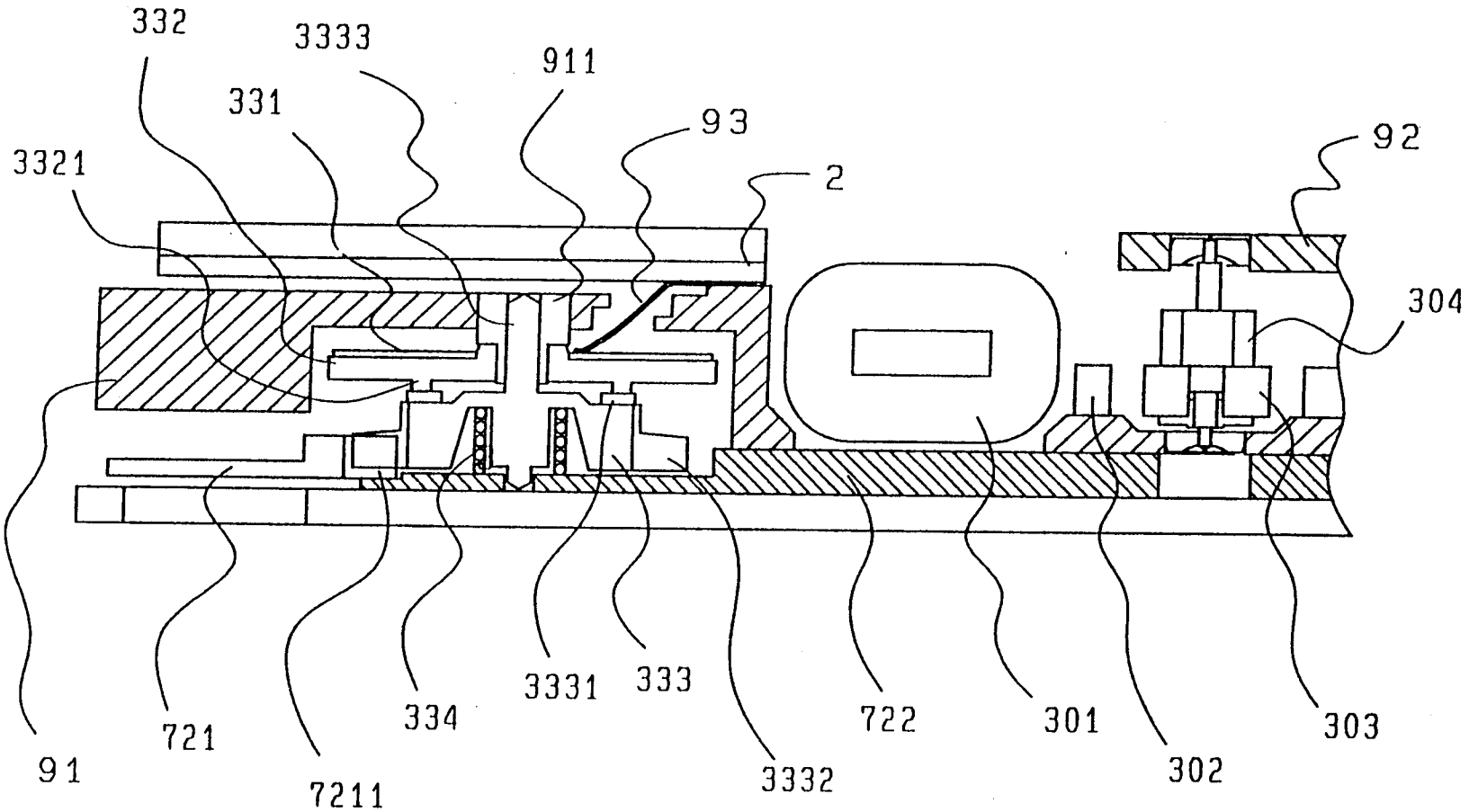
FIG. 2 is a longitudinal section view of the first embodiment of the analog electronic timepiece in the present invention.

FIGS. 1 and 2 show a first embodiment of analog electronic timepiece of the present invention.

In FIG. 1, an oscillation circuit 201 in an electronic circuit 2 oscillates, for example, 32,768 Hz of reference signal by receiving electrical energy from a power source 1. The reference signal is divided into, for example, 1 Hz in a frequency dividing circuit 202. The signal from the frequency dividing circuit 202 is sine wave. The signal from the frequency dividing circuit 202 which is sine wave is changed into rectangular wave in a pulse generating circuit 203 in order to accommodate with the rectangular wave of driving pulses for driving a stepping motor 3 and an ultrasonic motor 33. The pulse generating circuit 203 sends rectangular wave signals to a control circuit 225.

The control circuit 225 controls supplying timing of driving pulse of the stepping motor 3 which is a driving source of a time indicating mechanism 5 and driving pulse of the ultrasonic motor 33 which is a driving source of a calendar indicating mechanism. Then the control circuit 225 inputs a driving pulse command signal to a stepping motor driving circuit 224. The stepping motor driving circuit 224 provides driving pulse to the stepping motor 3. Further, it inputs the driving pulse command signal to a piezoelectric vibrator driving circuit 2261 for providing the driving pulse to the ultrasonic motor 33.

Here, in order to accelerate an electrostrictive effect of a piezoelectric vibrator 331 which structures the ultrasonic motor 33, an ultrasonic signal of, for example, 20 KHz to 40 KHz needs to be carried on the driving pulse of the ultrasonic motor 33. The electronic circuit 2 is provided with a driving pulse generating circuit 2263 to generate ultrasonic signals. The driving pulse generating circuit 2263 oscillates an ultrasonic signal of, for example, 20 KHz to 40 KHz and the output pulse generating circuit 2262 supplies the ultrasonic signal to the piezoelectric vibrator driving circuit 2261. Then the piezoelectric vibrator driving circuit 2261 combines the ultrasonic signal with the driving pulse command signal of 1 Hz of the control circuit 225 to make the driving pulse of the ultrasonic motor 33.

The driving pulse from the piezoelectric vibrator driving circuit 2261 induces the electrostrictive effect of the piezoelectric vibrator 331. The piezoelectric vibrator 331 vibrates and transmits the vibration to a vibrator 332. The vibrator 332 and a moving member 333 are pressurized and contacted by pressurizing force of an elastic pressurizing spring 334.

Due to that, a frictional force is generated between the vibrator 332 and the moving member 333 by the vibration of the vibrator 332. The moving member 333 performs rotation movement due to the vibration and the frictional force. Due to the rotation of the moving member 333, the calendar indicating mechanism 72 comprising a date plate on which date letters are printed is rotated.

The control circuit 225 controls supplying timing of the driving pulses to the ultrasonic motor 33 and to the stepping motor 3. A driving pulse command signal from the control circuit 225 whose supplying timing is controlled is input to a stepping motor driving circuit 224. The stepping motor driving circuit 224 supplies the driving pulse to the stepping motor 3 which is the driving source of the time indicating mechanism 5.

Correction of the indication of the time indicating mechanism 5 is carried out by a time correcting device 8.

The calendar indicating mechanism 72 comprises a date plate on which date letters are printed and others. Correction of the indication of the calendar indicating mechanism 72 is carried out by a date and month information input device 82. Correction signal of the date and month information input device 82 is input to the control circuit 225 and it induces a correction command signal to the piezoelectric vibrator driving circuit 2261. The piezoelectric vibrator driving circuit 2261 oscillates driving pulse for driving the ultrasonic motor 33. The indication of the calendar indicating mechanism 72 is corrected by driving the ultrasonic motor 33. Thereby, correct calendar information may be known swiftly to a carrier of the timepiece without interfering the drive of the time indicating mechanism 5.

In FIG. 2, the stepping motor 3 for driving the time indicating mechanism 5 comprises a coil 301, stator 302 and rotor 303, which are retained by a support member 91 and a train wheel bridge 92. The ultrasonic motor 33 drives the calendar indicating mechanism 72. The driving pulse of the ultrasonic motor 33 is generated from the electronic circuit 2 and a conductor 93 supplies the driving pulse of the ultrasonic motor 33 to the piezoelectric vibrator 331. The piezoelectric vibrator 331 induces high frequency vibration by electrostrictive effect. The vibrator 332 is excited and vibrated by receiving the high frequency vibration of the piezoelectric vibrator 331.

The vibrator 332 and the moving member 333 are pressurized and contacted by the pressurizing spring 334. The vibrator 332 is provided with projections 3321 for amplifying the vibration. The moving member 333 is provided with a sliding section 3331 for enhancing frictional force. Due to that, a frictional force is generated between the projections 3321 of the vibrator 332 and the sliding section 3331 of the moving member 333.

The moving member 333 rotates centering on a shaft 3333 of the moving member 333 which is engaged with a moving member guiding section 911 of the support member 91. The moving member 333 is provided with a gear section 3332 of the moving member 333 which engages with a gear section 7211 of the date plate 721. When the moving member 333 rotates, the indication of the date plate 721 is switched and the rotation of the date plate 721 is accelerated. Here, since the rotation of the moving member 333 is driven by the frictional force with the vibrator 332, no magnetic field is generated from the ultrasonic motor 33. The ultrasonic motor 33 will not magnetically effect the stepping motor 3 which is driven by electromagnetic conversion.

Due to that, the ultrasonic motor 33 may be laid out without regarding to the position of the stepping motor 3, thereby contributing for down-sizing of the electronic timepiece.

Further, the pressurizing spring 334 presses the moving member 333 which engages with the date plate 721. Due to the pressure of the pressurizing spring 334, a holding power of the moving member 333 is kept strong and is not influenced by external shock. A holding power of the date plate 721 which engages with the moving member 333 is also strong, so that the date plate 721 will not erroneously operates due to external shock.

Accordingly, the present invention obviates the conventional date jumper.

FIGS. 3 to 12 show a second embodiment of the analog electronic timepiece in the present invention.

Figure 3:
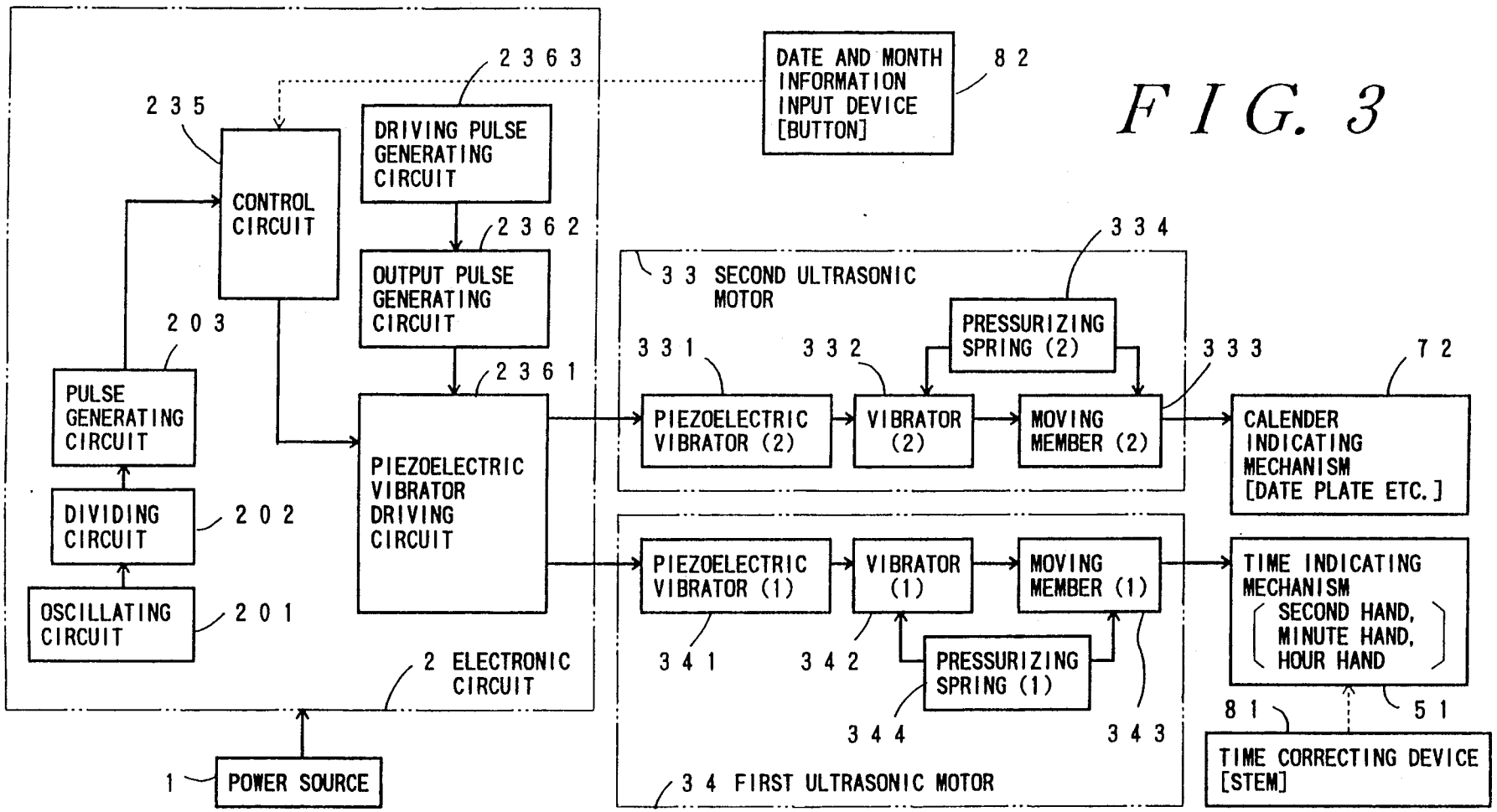
FIG. 3 is a block diagram illustrating a second embodiment of the analog electronic timepiece of the present invention.
Figure 4:
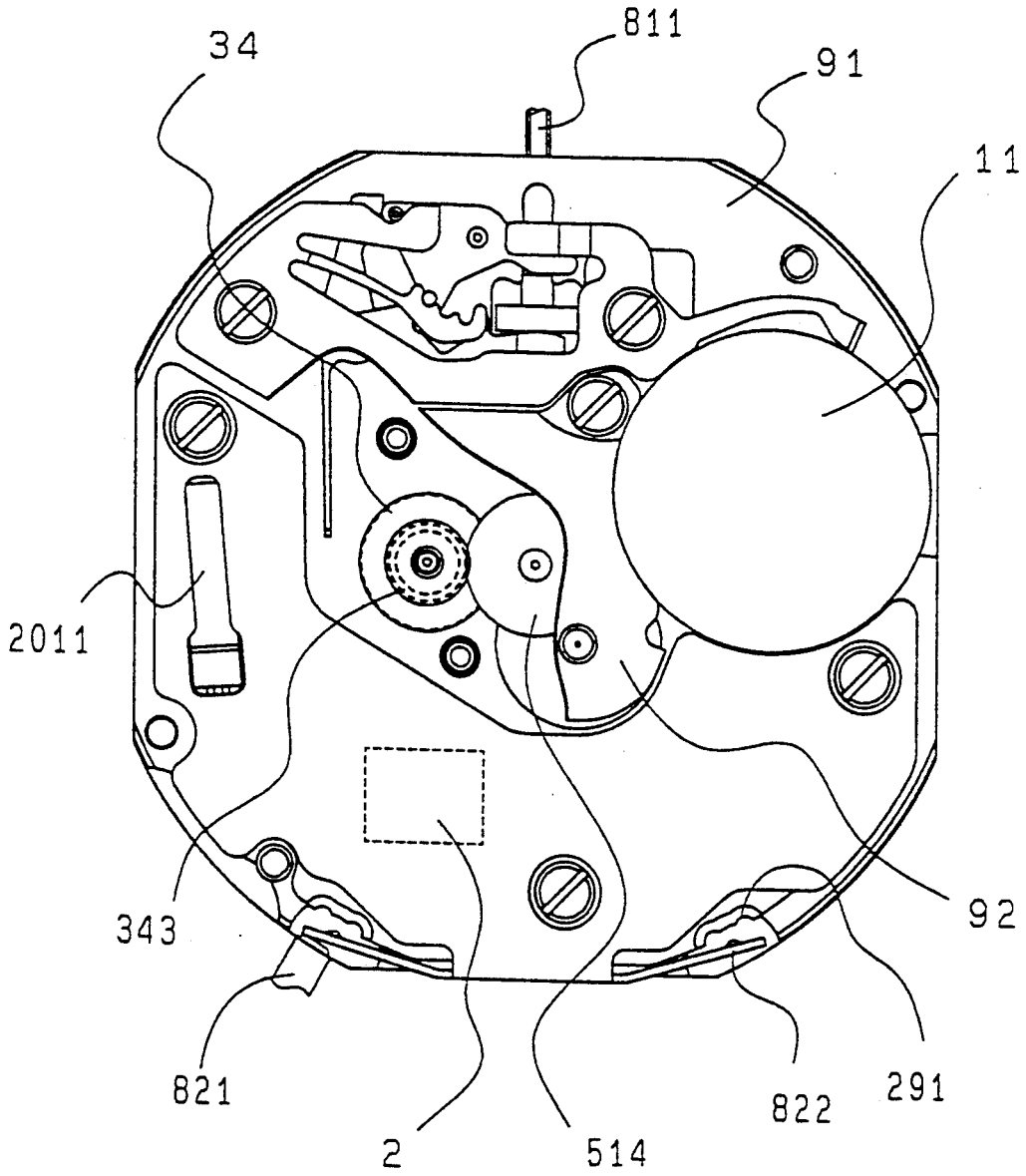
FIG. 4 is a front plan view of the second embodiment of the analog electronic timepiece in the present invention.
Figure 5:
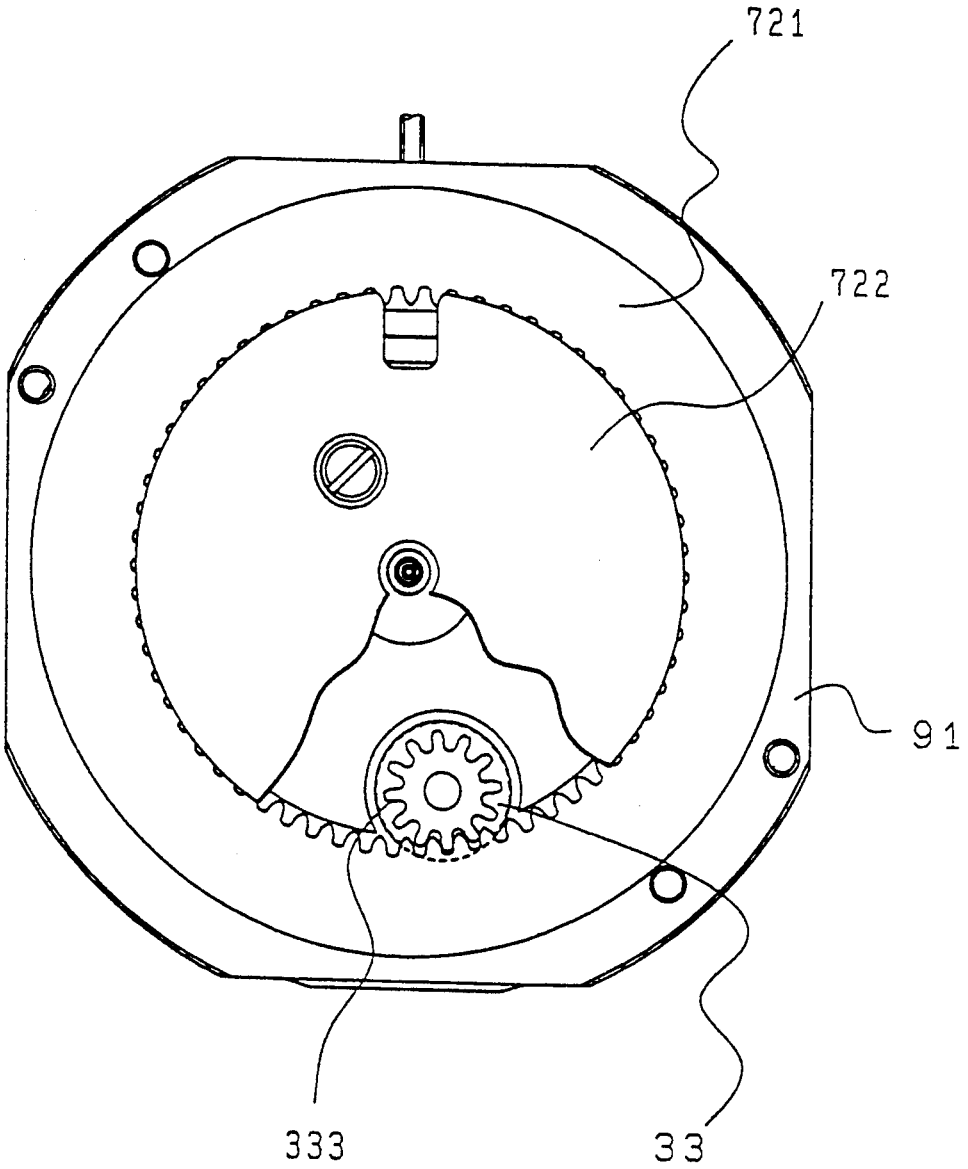
FIG. 5 is a back plan view of the second embodiment of the analog electronic timepiece in the present invention.
Figure 6:
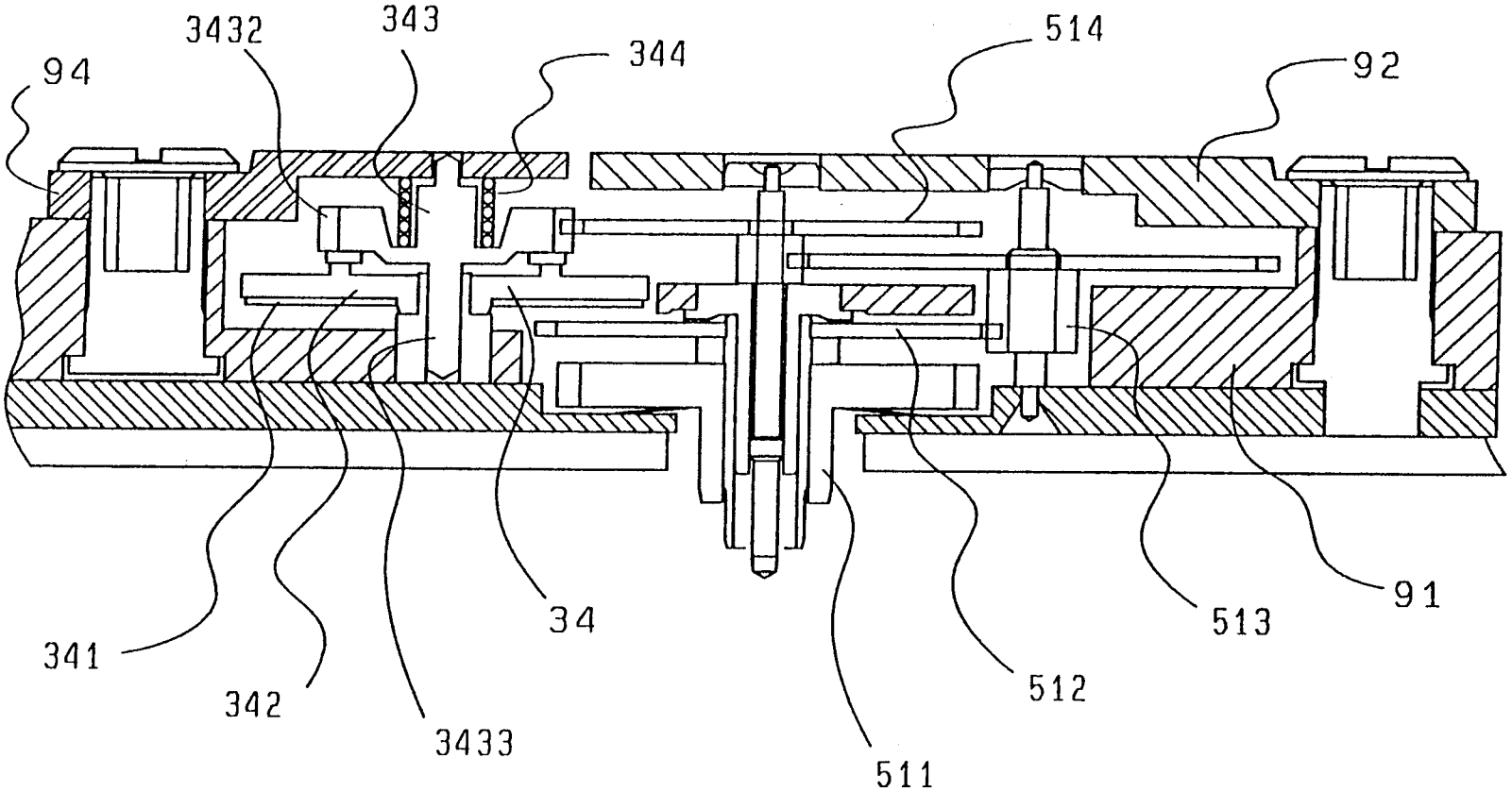
FIG. 6 is a longitudinal section view of a driving source for indicating time of the second embodiment of the analog electronic timepiece in the present invention.
Figure 7:
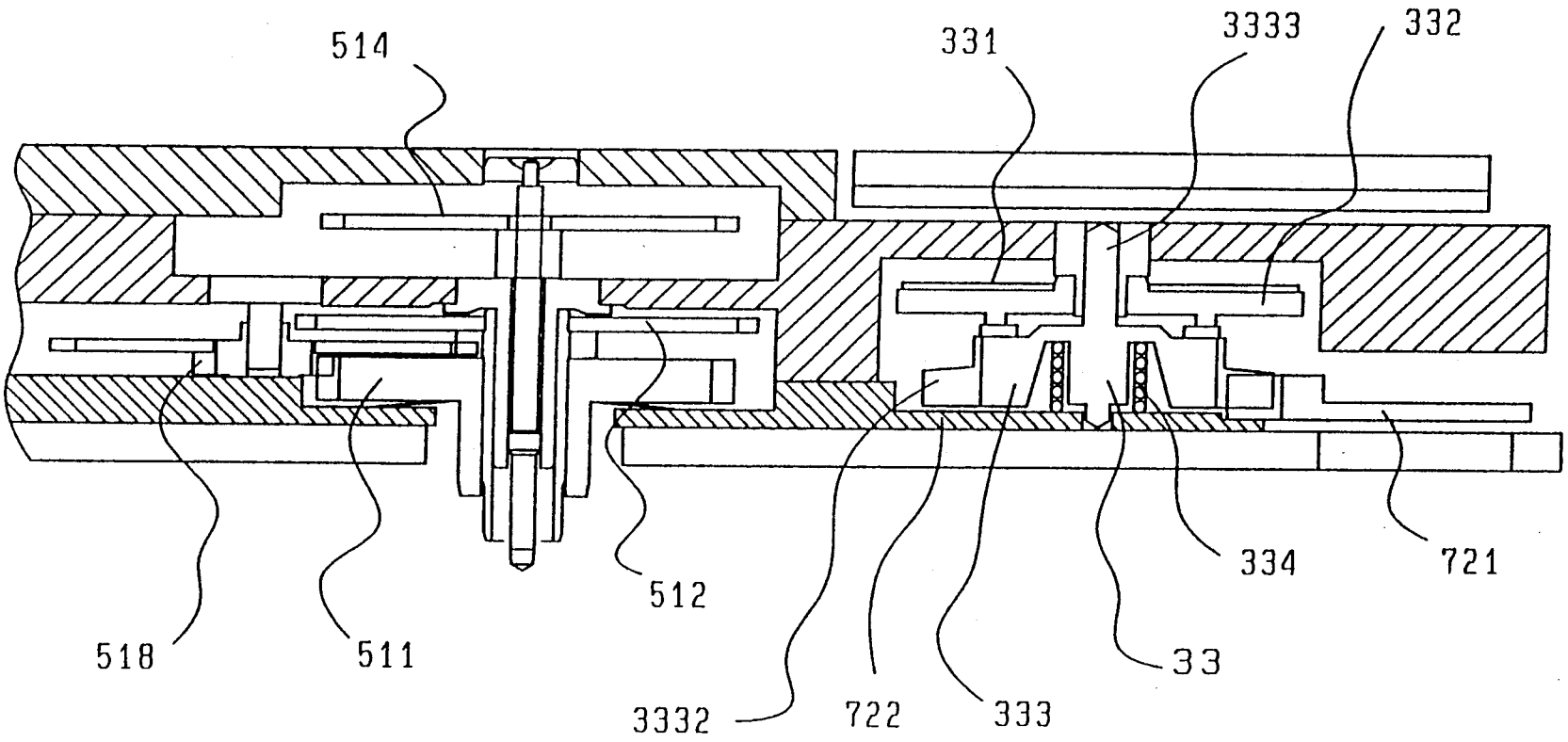
FIG. 7 is a longitudinal section view of a driving source for indicating a calendar of the second embodiment of the analog electronic timepiece in the present invention.
Figure 8:
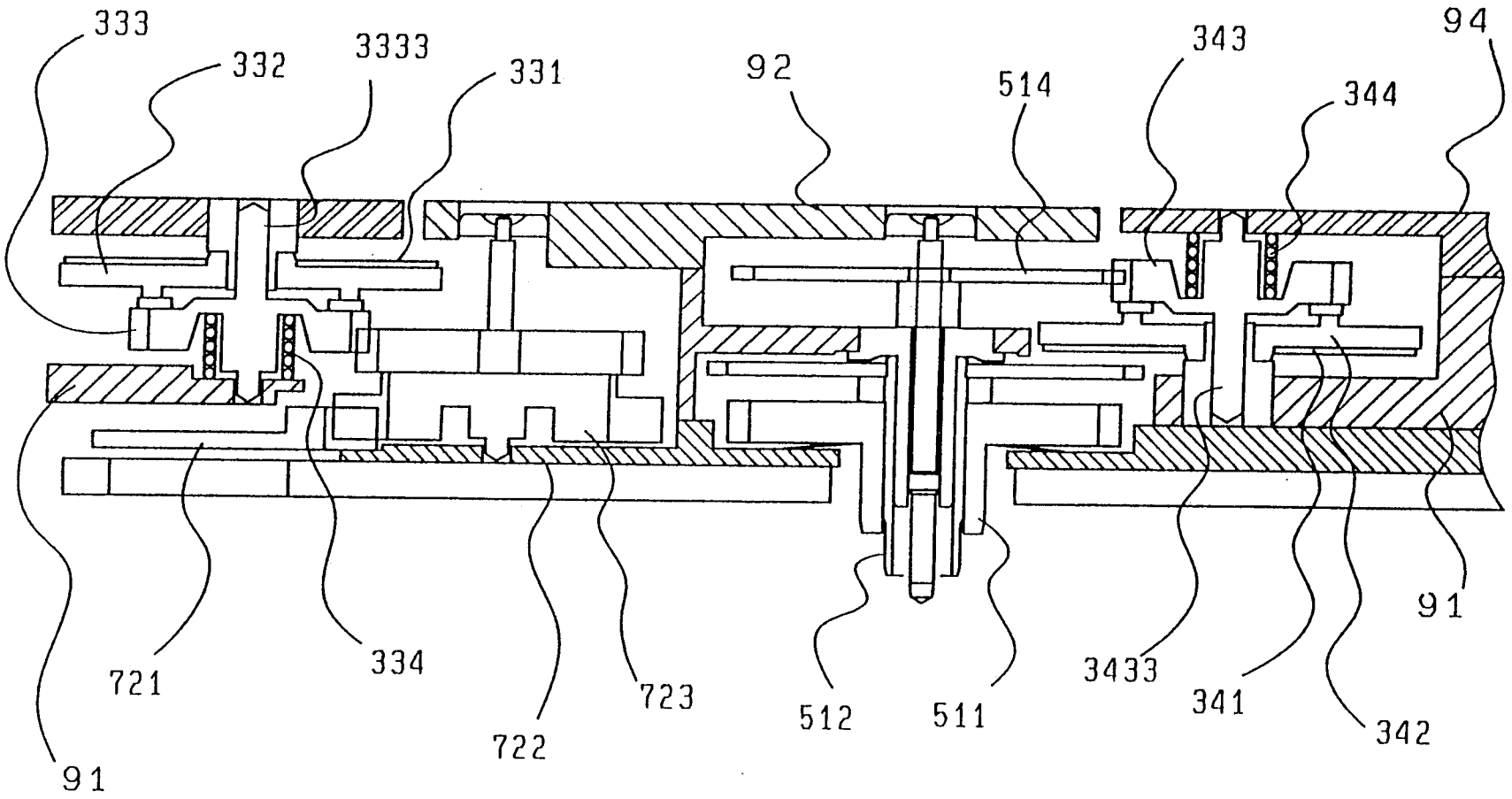
FIG. 8 is a first longitudinal section view of a plurality of driving sources of the second embodiment of the analog electronic timepiece in the present invention.

FIG. 3 shows an embodiment in which a first ultrasonic motor 34 is provided as a driving source for driving a time indicating mechanism. The control circuit 235 controls supplying timing of driving pulses of the first ultrasonic motor 34 for driving a time indicating mechanism 51 and driving pulses of the second ultrasonic motor 33 for driving the calendar indicating mechanism 72. The control circuit 235 inputs a driving pulse command signal to a piezoelectric vibrator driving circuit 2361 for providing driving pulses whose generating timing is controlled to the first ultrasonic motor 34.

Here, in order to accelerate an electrostrictive effect of a piezoelectric vibrator 341 which structures the first ultrasonic motor 34, an ultrasonic signal of, for example, 20 KHz to 40 KHz needs to be carried on the driving pulses of the first ultrasonic motor 34. The electronic circuit 2 is provided with a driving pulse generating circuit 2363 for oscillating an ultrasonic signal of, for example, 20 KHz to 40 KHz. The signal of the driving pulse generating circuit 2363 supplies the ultrasonic signal to the piezoelectric vibrator driving circuit 2261 through the intermediary of an output pulse generating circuit 2362.

The piezoelectric vibrator driving circuit 2261 combines the ultrasonic signal with the driving pulse command signal of 1 Hz of the control circuit 235 to make the driving pulse of the first ultrasonic motor 34.

The driving pulse from the piezoelectric vibrator driving circuit 2261 induces the electrostrictive effect of the piezoelectric vibrator 341. The piezoelectric vibrator 341 vibrates and transmits the vibration to a vibrator 342. The vibrator 342 and a moving member 343 are pressurized and contacted by a pressurizing force of an elastic pressurizing spring 344.

Due to that, a frictional force is generated between the vibrator 342 and the moving member 343 by the vibration of the vibrator 342 and thereby the moving member 343 performs rotation movement. Due to the rotation of the moving member 343, the time indicating mechanism 51 is driven. Correction of time indicated by the time indicating mechanism 51 is performed by a time correcting device 81. Reference signal of a quartz vibrator 2011 is oscillated by the electrical energy of the battery 11 and the electronic circuit 2 is driven. The first ultrasonic motor 34 for driving the time indicating mechanism for indicating time and the second ultrasonic motor 33 for driving the calendar indicating mechanism are driven by the driving pulses of the electronic circuit 2.

The rotation of the first ultrasonic motor 34 is transmitted to a fourth gear 514 to drive a hand for indicating time. The first ultrasonic motor 34 for driving the time indicating mechanism 51 supplies the driving pulse from the electronic circuit 2. A high frequency vibration by electrostrictive effect is induced in the piezoelectric vibrator 341 of the first ultrasonic motor 34. The vibrator 342 is excited and vibrated by receiving the high frequency vibration of the piezoelectric vibrator 341.

The vibrator 342 and the moving member 343 are pressurized and contacted by the pressurizing spring 344 held by a pressurizing spring holder 94. Due to that, a frictional force is generated between the projections 3421 of the vibrator 342 for amplifying the vibration of the vibrator 342 and the sliding section 3431 of the moving member 343.

The moving member 343 rotates centering on a shaft 3433 of the moving member 343 which is engaged with a moving member guiding section 911 of the support member 91. The moving member 343 is provided with a gear section 3432 of the moving member 343 which engages with the fourth gear 514. When the moving member 343 rotates, the fourth gear rotates and the indication of the time is switched. Here, since the pressurizing spring 344 presses the moving member 343 which engages with the fourth gear 514, a holding power of the moving member 343 is kept strong.

Further, since it is stronger than slip torque of a slip section 5121 of a center gear 512 which counterpoises with transmission torque due to correction of time by a winding stem 881 of the time correcting device 81 and since the transmission torque by the correction of time by winding stem core 881 is absorbed at the slip section 5121 of the center gear 512, an adjusting member 95 is obviated.

Correction of the indication of the date plate 721 of the calendar indicating mechanism is carried out by manipulating a button 821 which is the date and month information input device 82. An external signal input device 822 issues a correction command to the electronic circuit 2 to urge a command pattern 291 of the electronic circuit 2 to correct the indication of the date plate 721 of the calendar indicating mechanism. Then the electronic circuit 2 supplies a correction driving pulse to the second ultrasonic motor 33. The second ultrasonic motor 33 is driven to correct the indication of the date plate 721, thereby completing the correction of the date plate 721.

As described above, a significant effect is brought about by combining the ultrasonic motors as driving sources. Further, since the ultrasonic motors will generate no magnetic field, they will not restrict locations of the stepping motors. Then, the plurality of motors need not be disposed at separate locations on a plane and may be disposed laminating each other.

Figure 9:
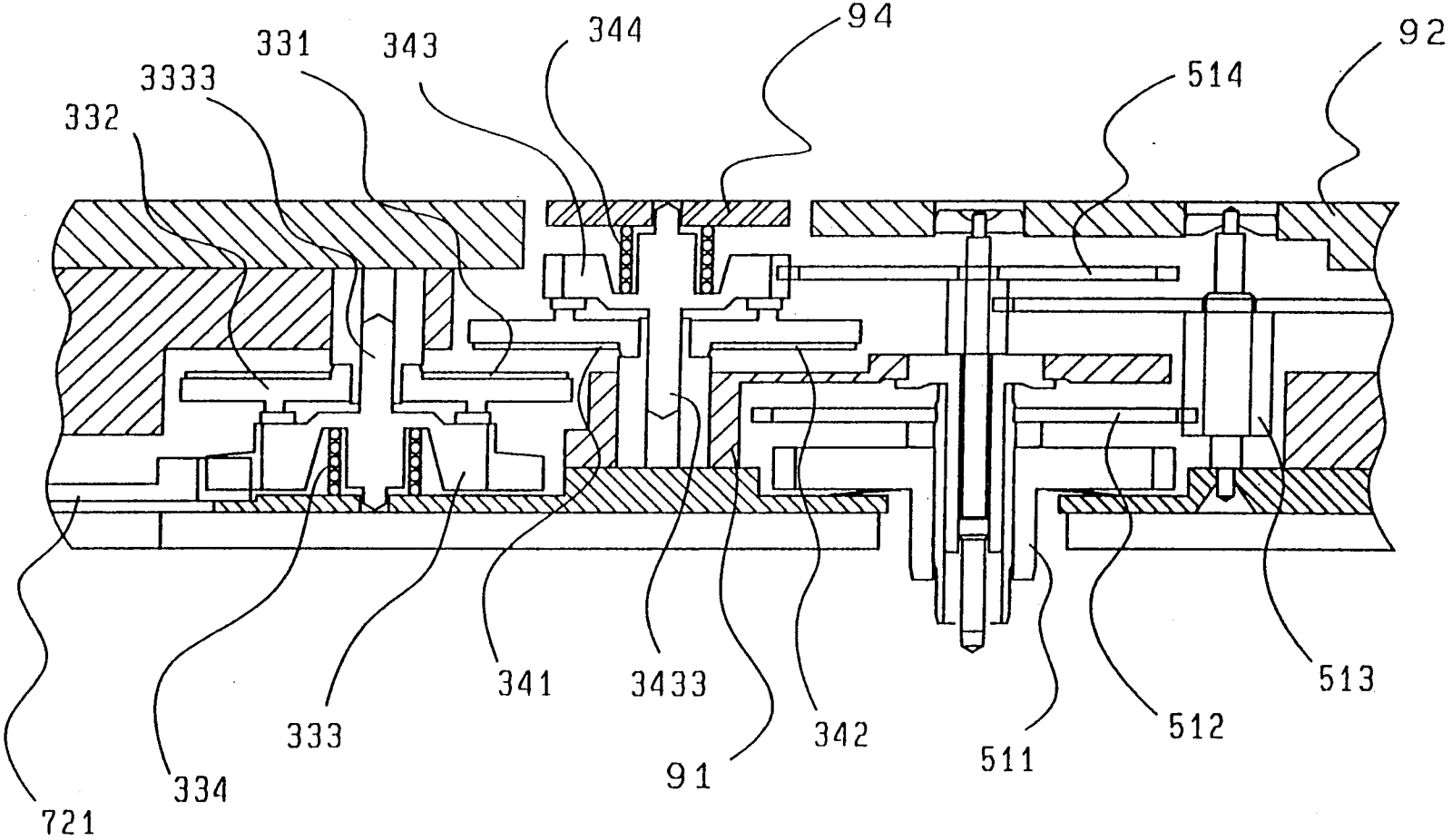
FIG. 9 is a second longitudinal section view of the plurality of driving sources of the second embodiment of the analog electronic timepiece in the present invention.

In FIG. 9, a part the piezoelectric vibrator 331 of the second ultrasonic motor 33 and a part the piezoelectric vibrator 341 of the first ultrasonic motor 34 are disposed by being piled each other.

Figure 10:
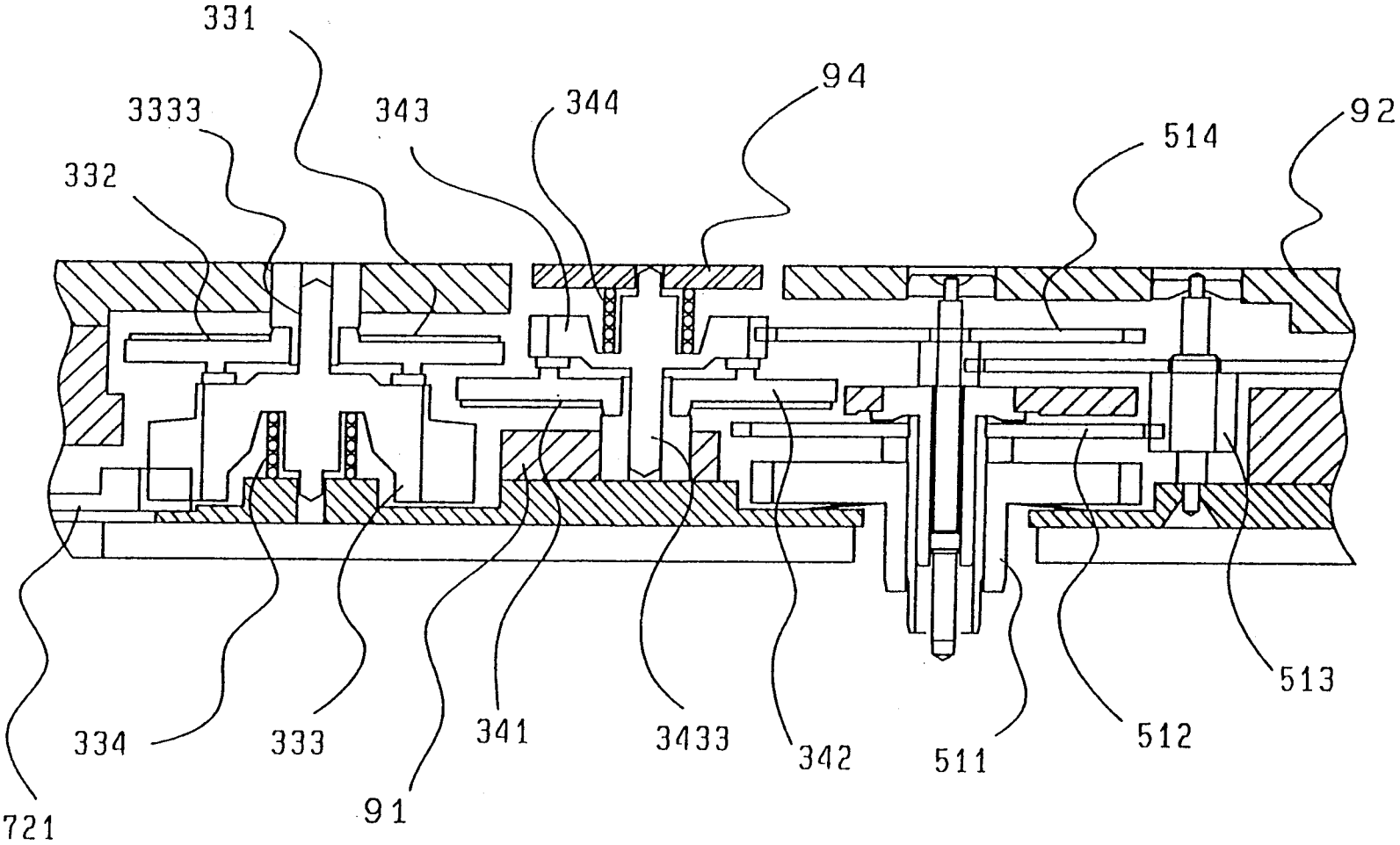
FIG. 10 is a third longitudinal section view of the plurality of driving sources of the second embodiment of the analog electronic timepiece in the present invention.

In FIG. 10, a vibrator 342 of the first ultrasonic motor 34 is disposed between the vibrator the vibrator 332 and the moving member 333 of the second ultrasonic motor 33.

Figure 11:
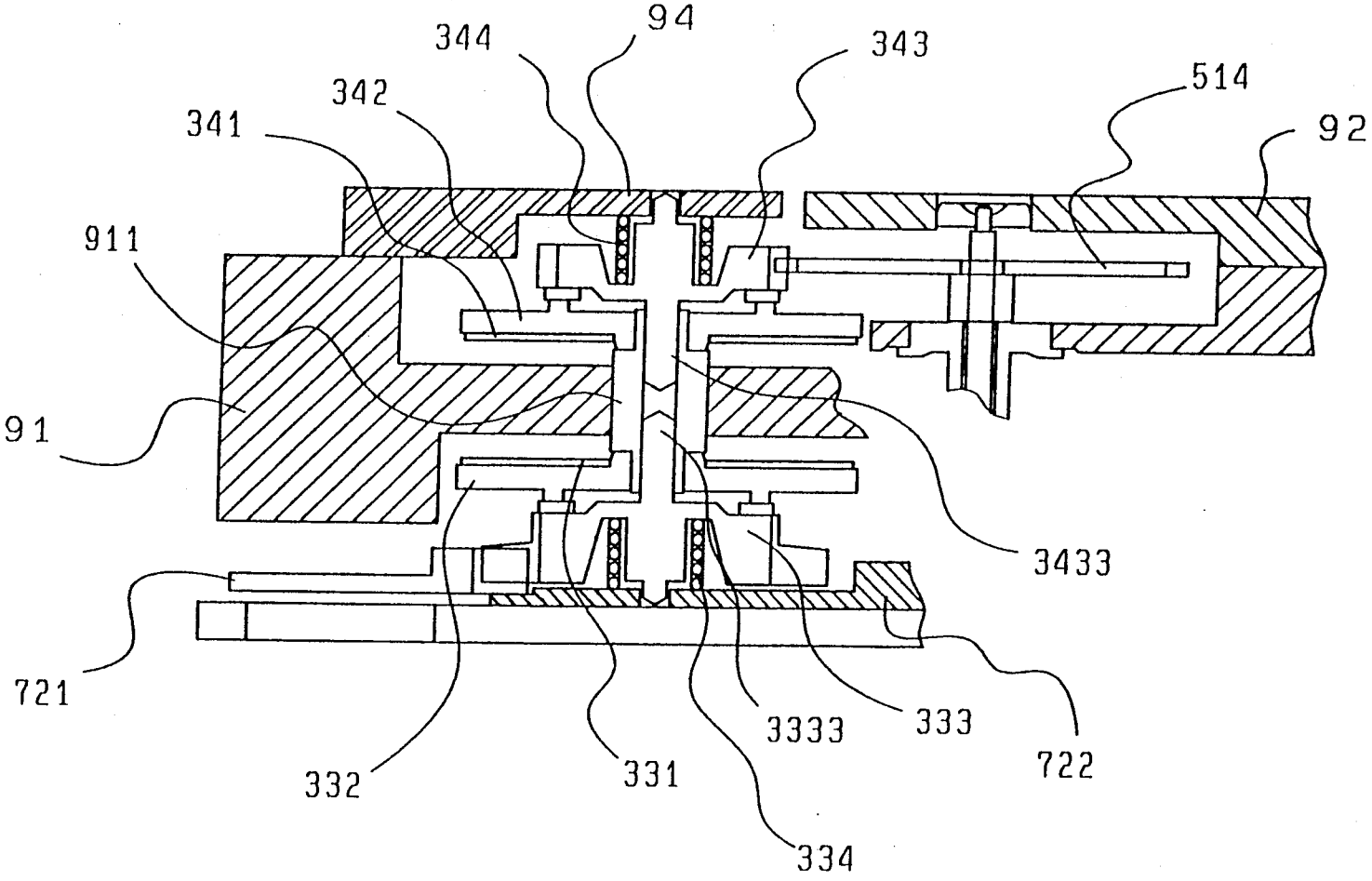
FIG. 11 is a fourth longitudinal section view of the plurality of driving sources of the second embodiment of the analog electronic timepiece in the present invention.

In FIG. 11, a shaft section 3333 of the moving member 333 of the second ultrasonic motor 33 and a shaft section 3433 of the moving member 343 of the first ultrasonic motor 34 are engaged in a mover guiding section 911 of the same support member 91. Accordingly, it significantly contributes for down-sizing of the electronic timepiece.

Figure 12:
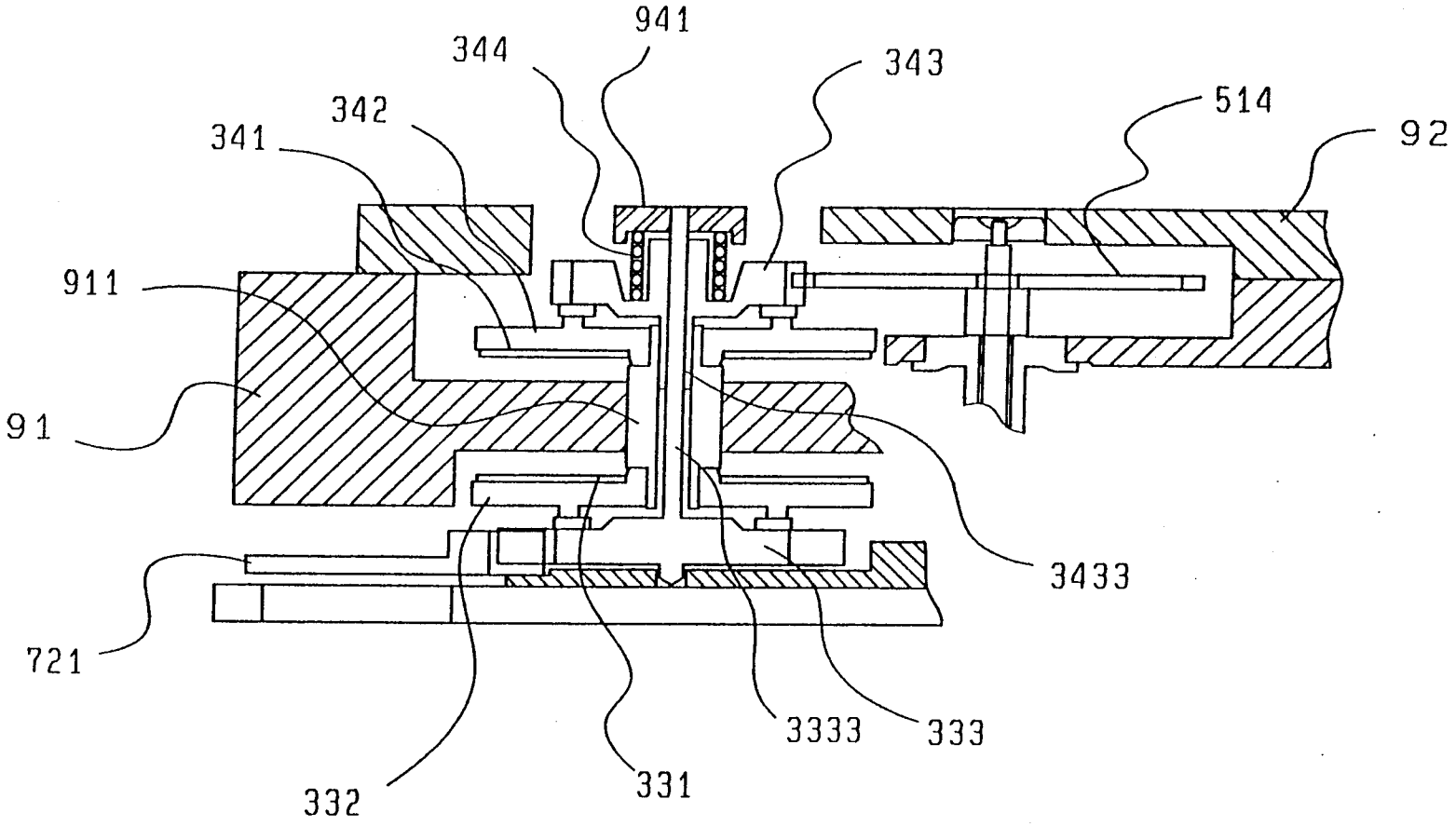
FIG. 12 is a fifth longitudinal section view of the plurality of driving sources of the second embodiment of the analog electronic timepiece in the present invention.

Further in FIG. 12, the shaft section 3433 of the moving member 343 of the first ultrasonic motor 34 is made hollow to provide the shaft section 3333 of the moving member 333 of the second ultrasonic motor 33 penetrating the hollow shaft section 3433 of the moving member 343 of the first ultrasonic motor 34. A pressurizing spring cap 941 for retaining a first pressurizing spring 343 at the shaft section 3333 of the moving member 333 of the second ultrasonic motor 33 is also provided to be able to give the elastic force of the pressurizing spring 344 to the second ultrasonic motor 33 and the first ultrasonic motor 34. The pressurizing spring and the pressurizing spring maintaining plate may be shared by one part, so that the number of parts may be decreased.

Also, since there is no dispersion in the elastic force to the second ultrasonic motor 33 and the first ultrasonic motor 34, a stable driving is allowed and the reliability of the driving sources is enhanced.

Furthermore, the use of the ultrasonic motor 34 for the driving source for driving such pointers for indicating seconds by rotating once in one minutes allows combined use of parts of the second ultrasonic motor 33 and the first ultrasonic motor 34.

Figure 13:
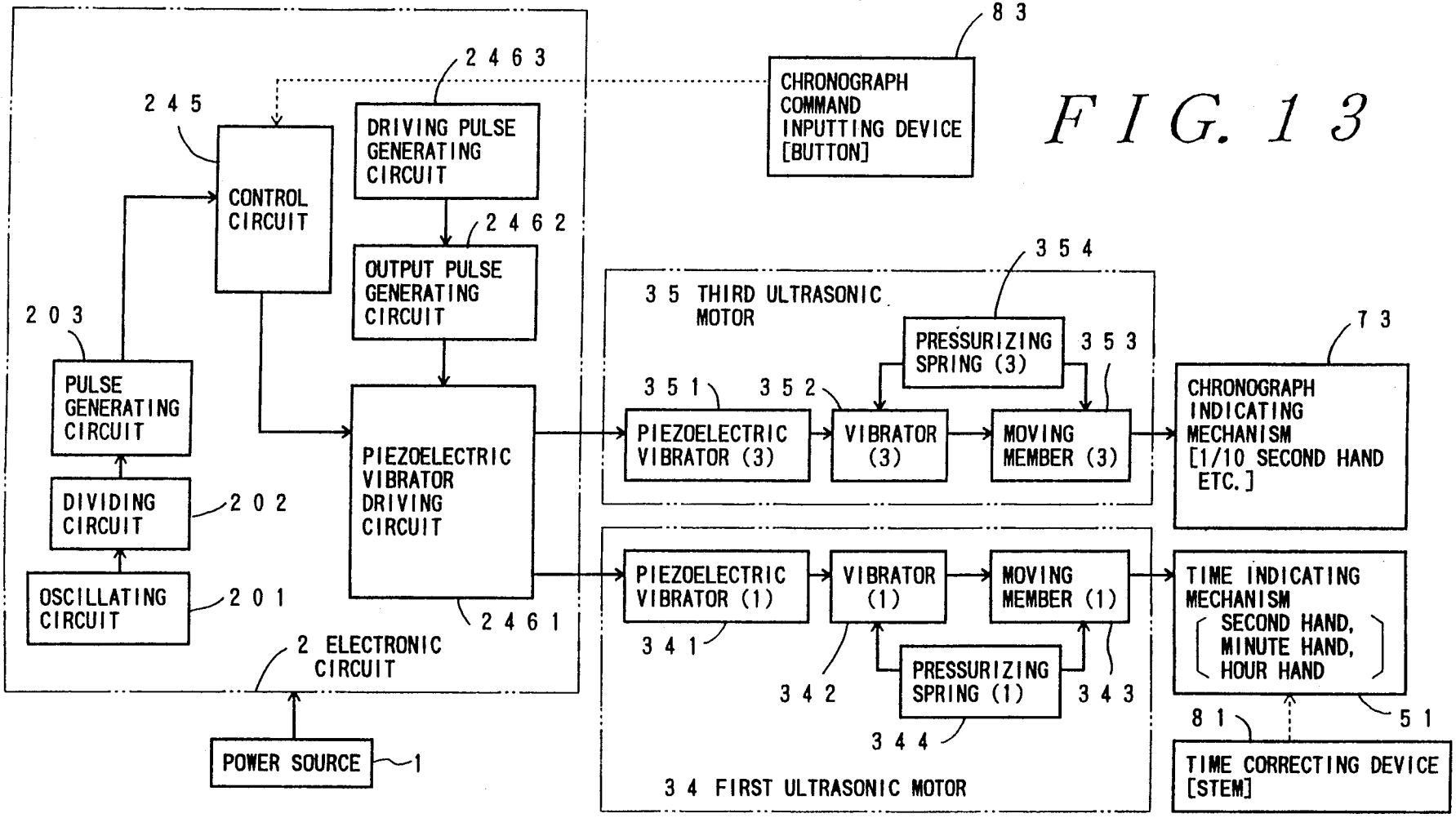
FIG. 13 is a block diagram illustrating a third embodiment of the analog electronic timepiece of the present invention.
Figure 14:
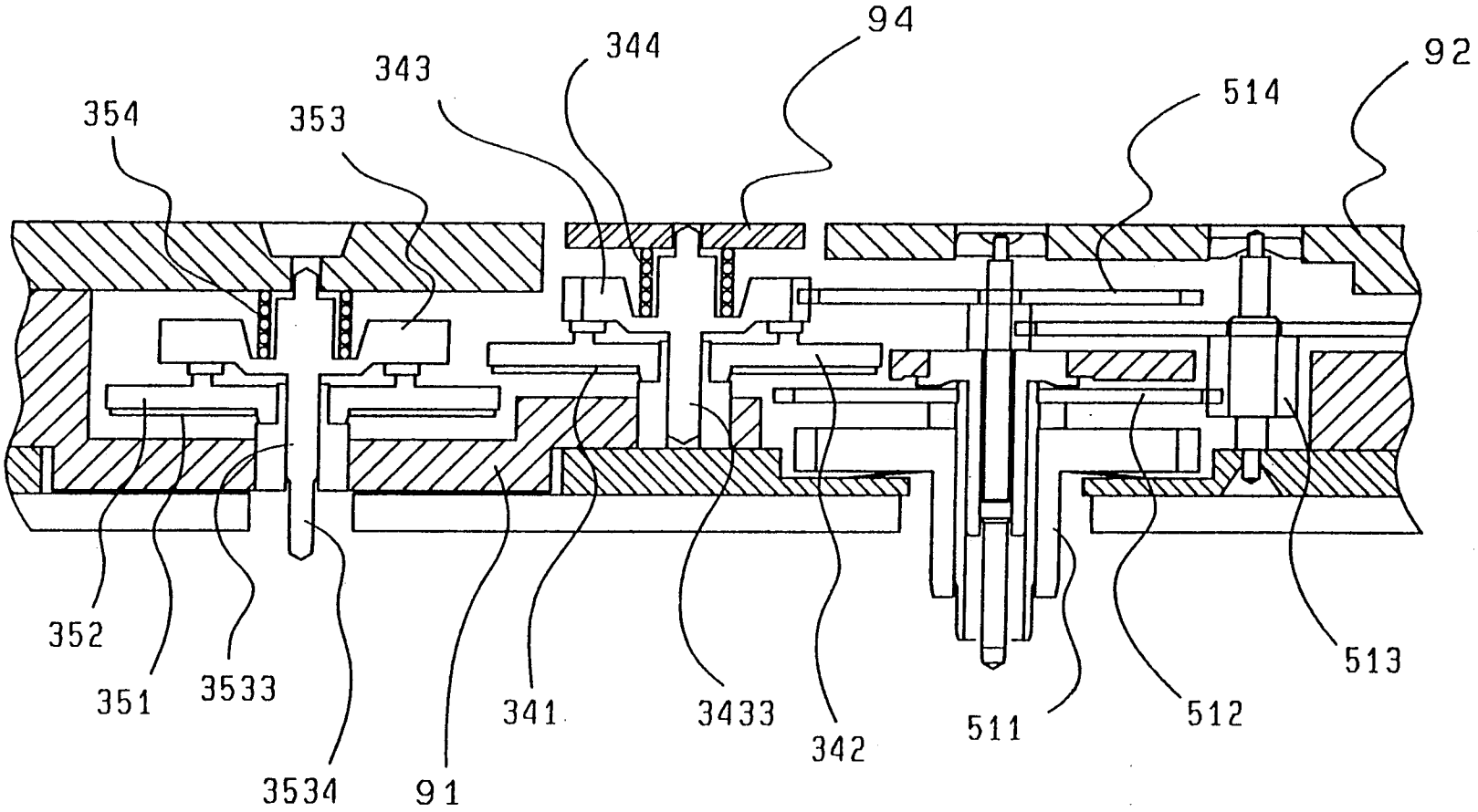
FIG. 14 is a longitudinal section view of the third embodiment of the analog electronic timepiece of the present invention.
Figure 15:
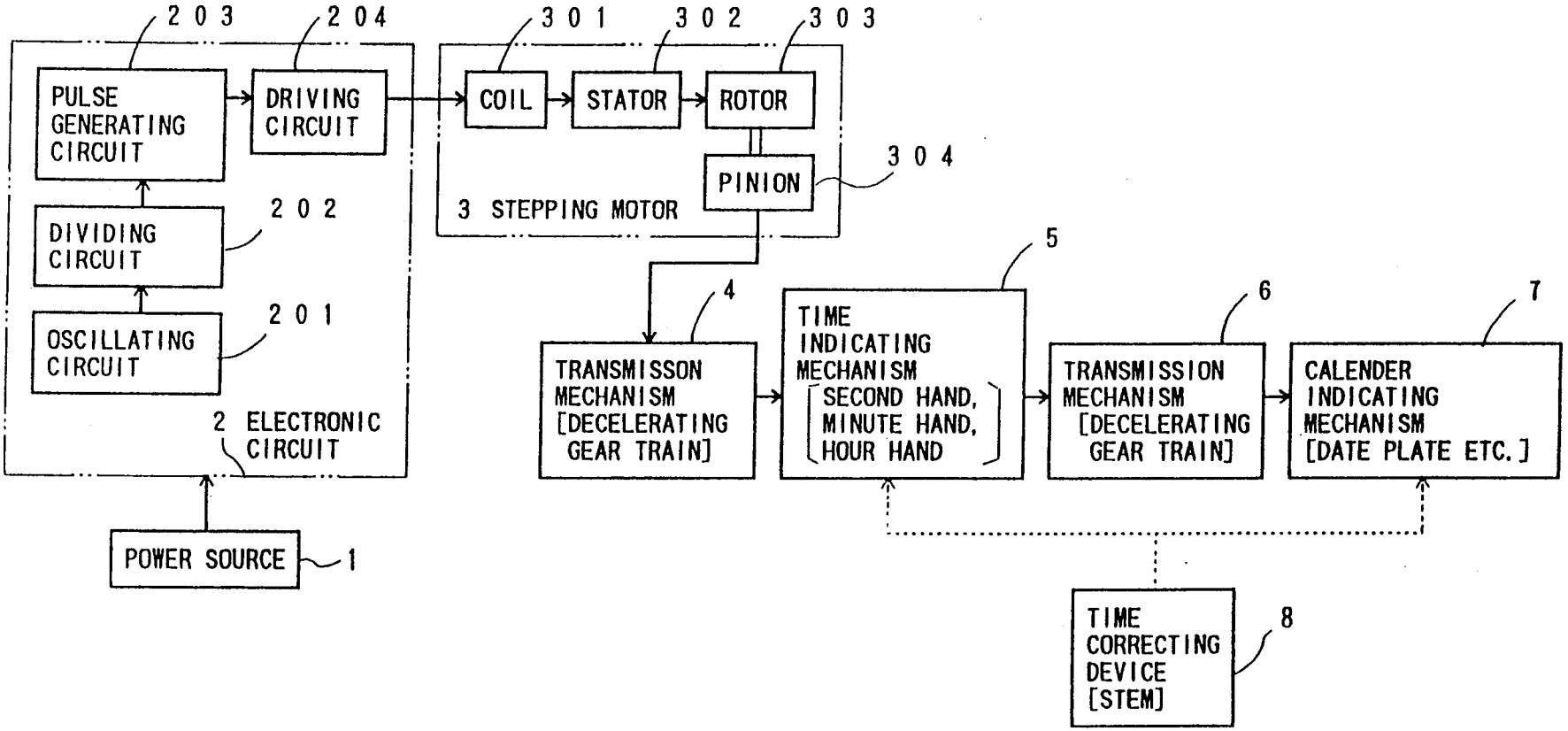
FIG. 15 is a first block diagram of a prior art analog electronic timepiece.
Figure 16:
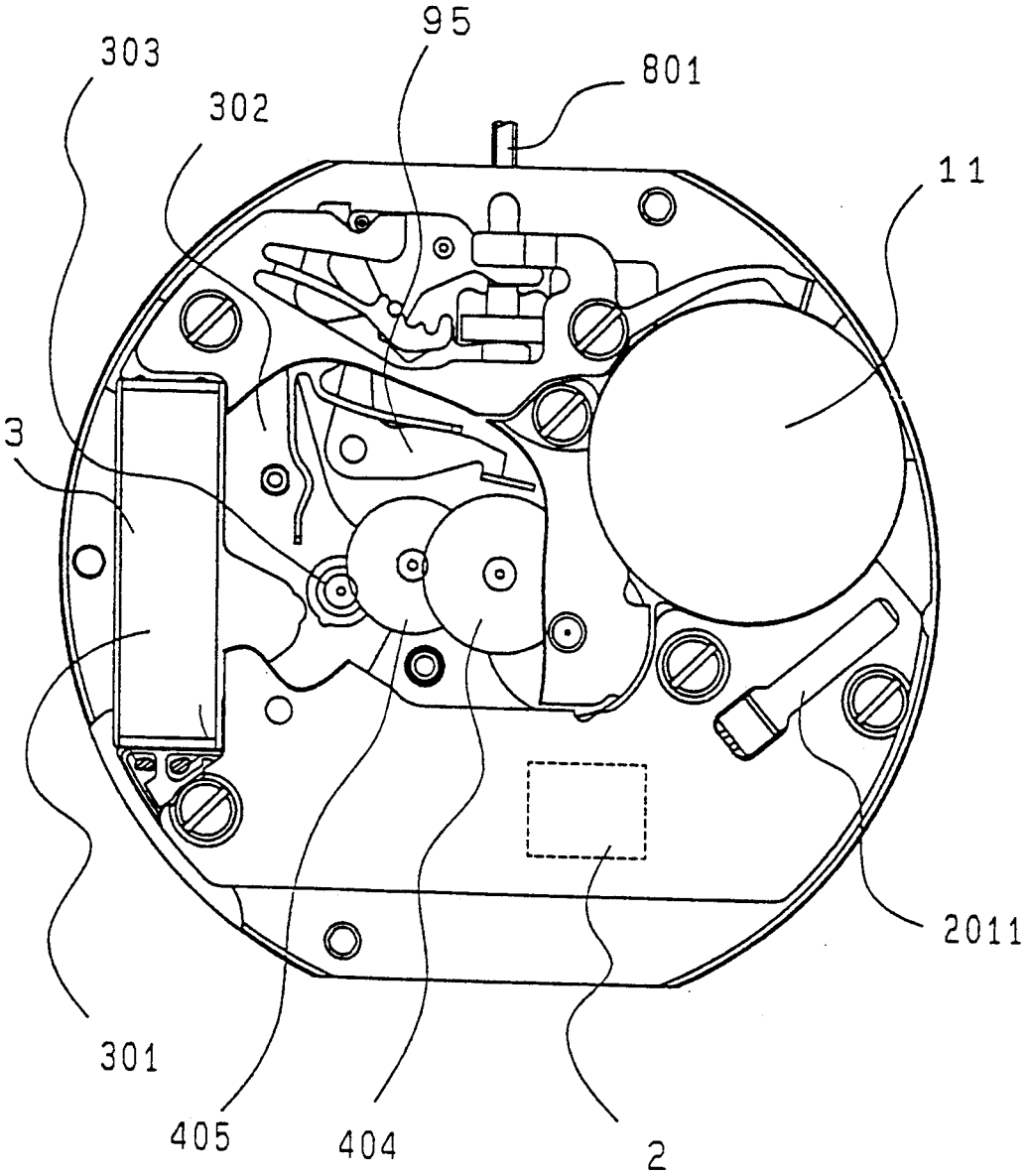
FIG. 16 PRIOR ART
FIG. 16 is a front plan view of the prior art analog electronic timepiece.
Figure 17:
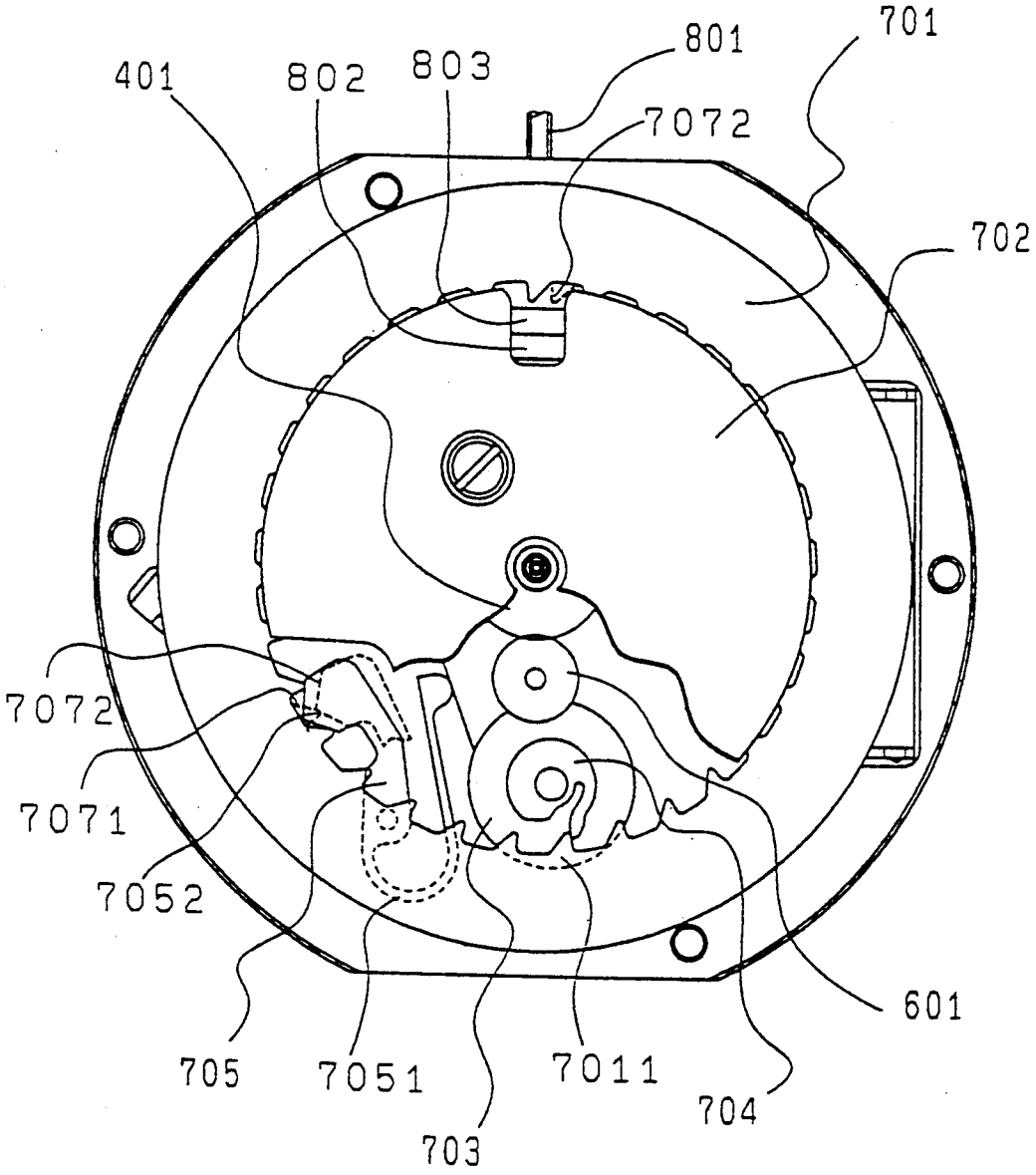
FIG. 17 PRIOR ART
FIG. 17 is a back plan view of the prior art analog electronic timepiece.
Figure 18:
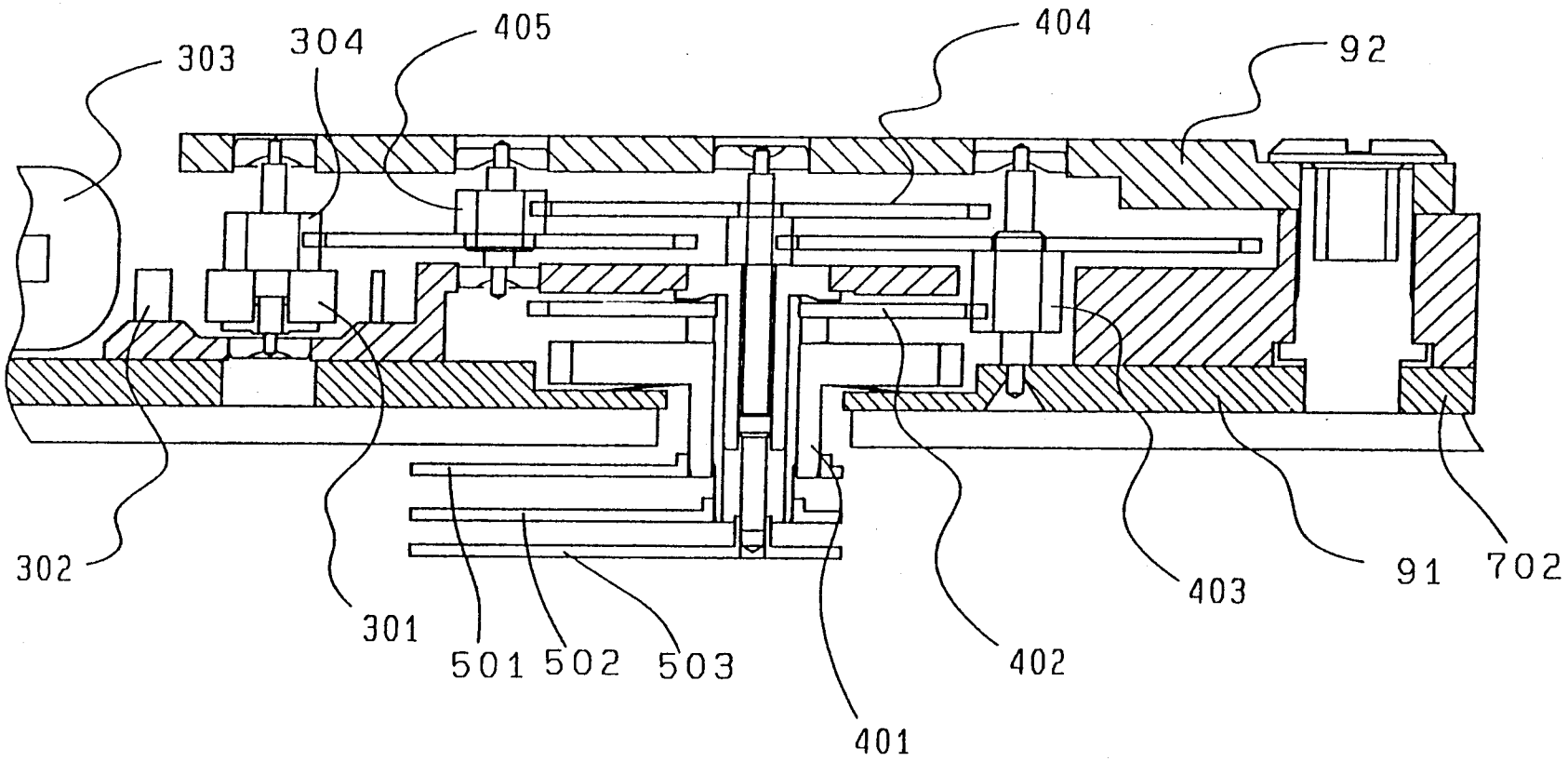
FIG. 18 PRIOR ART
FIG. 18 is a longitudinal section view illustrating a time indicating section of the prior art analog electronic timepiece.
Figure 19:
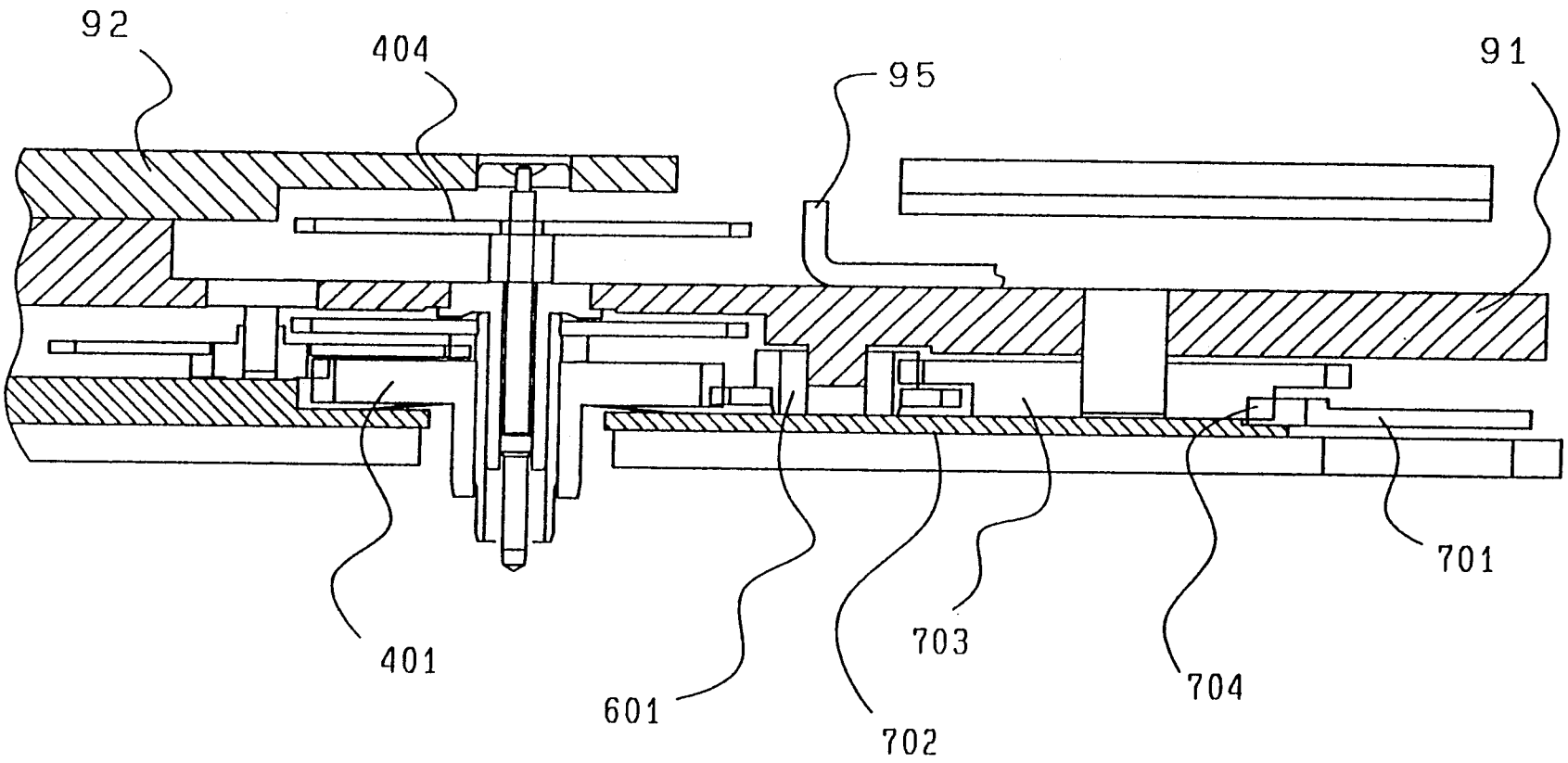
FIG. 19 PRIOR ART
FIG. 19 is a first longitudinal section view illustrating a calendar indicating section of the prior art analog electronic timepiece.
Figure 20:
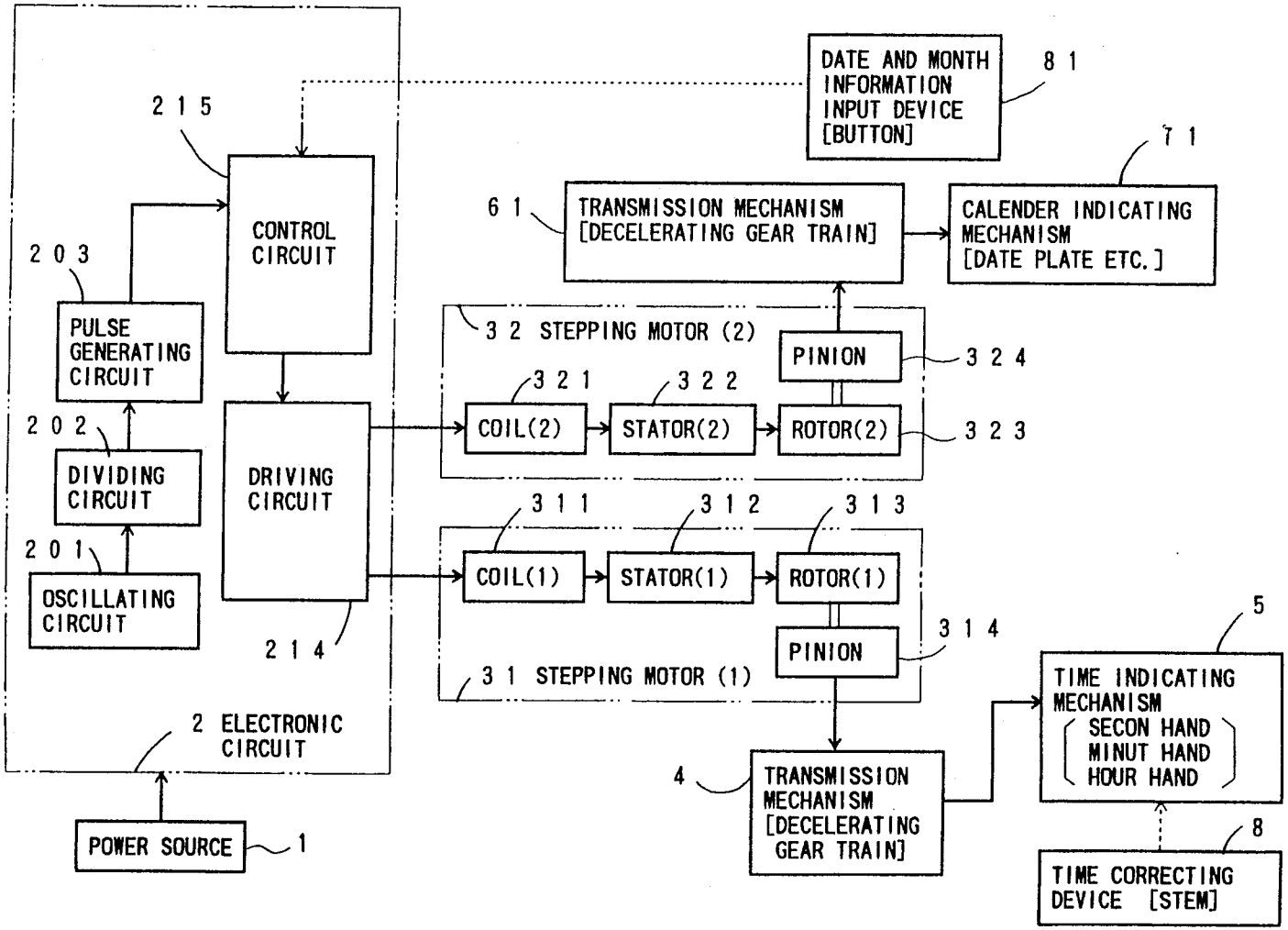
FIG. 20 PRIOR ART
FIG. 20 is a second block diagram of the prior art analog electronic timepiece.
Figure 21:
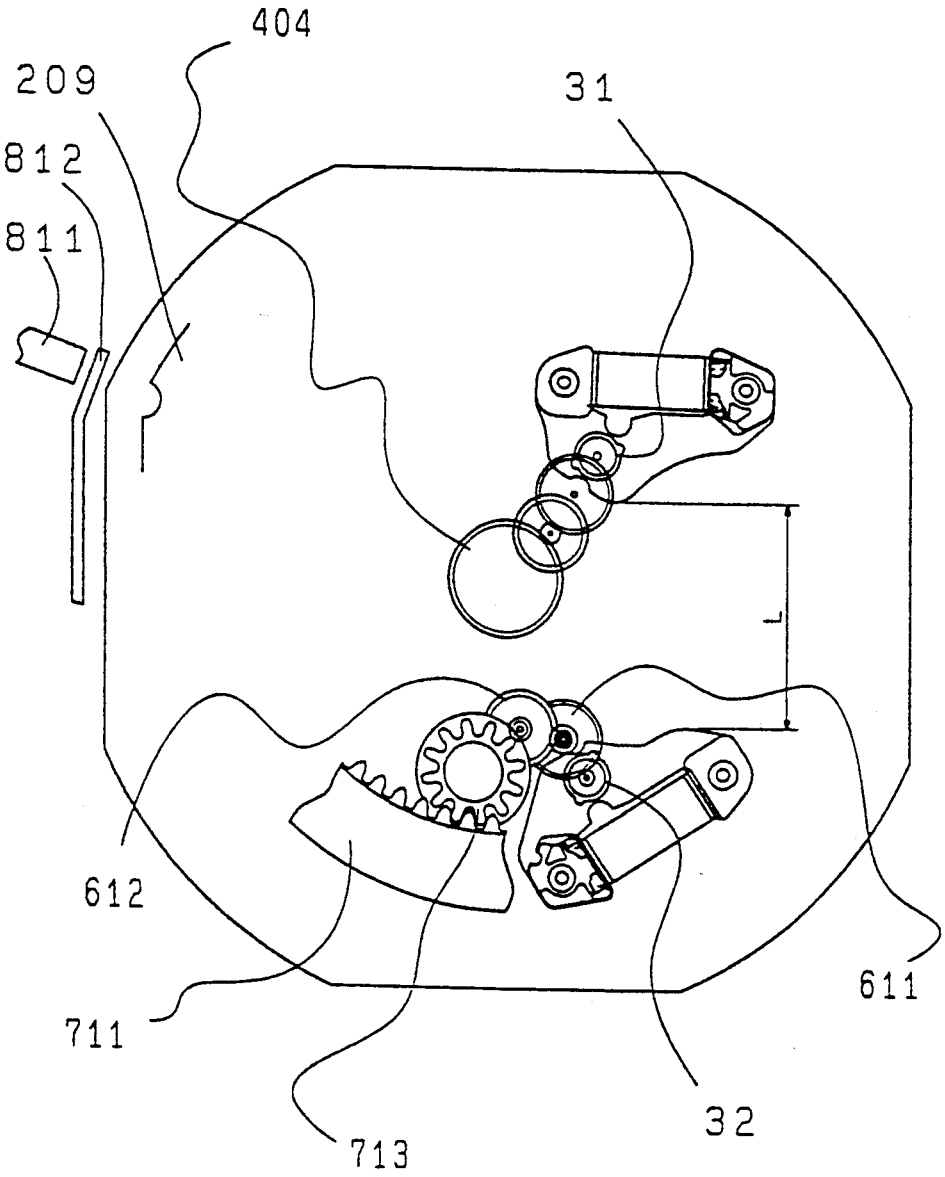
FIG. 21 PRIOR ART
FIG. 21 is a front plan view of the prior art analog electronic timepiece having a plurality of driving sources.
Figure 22:
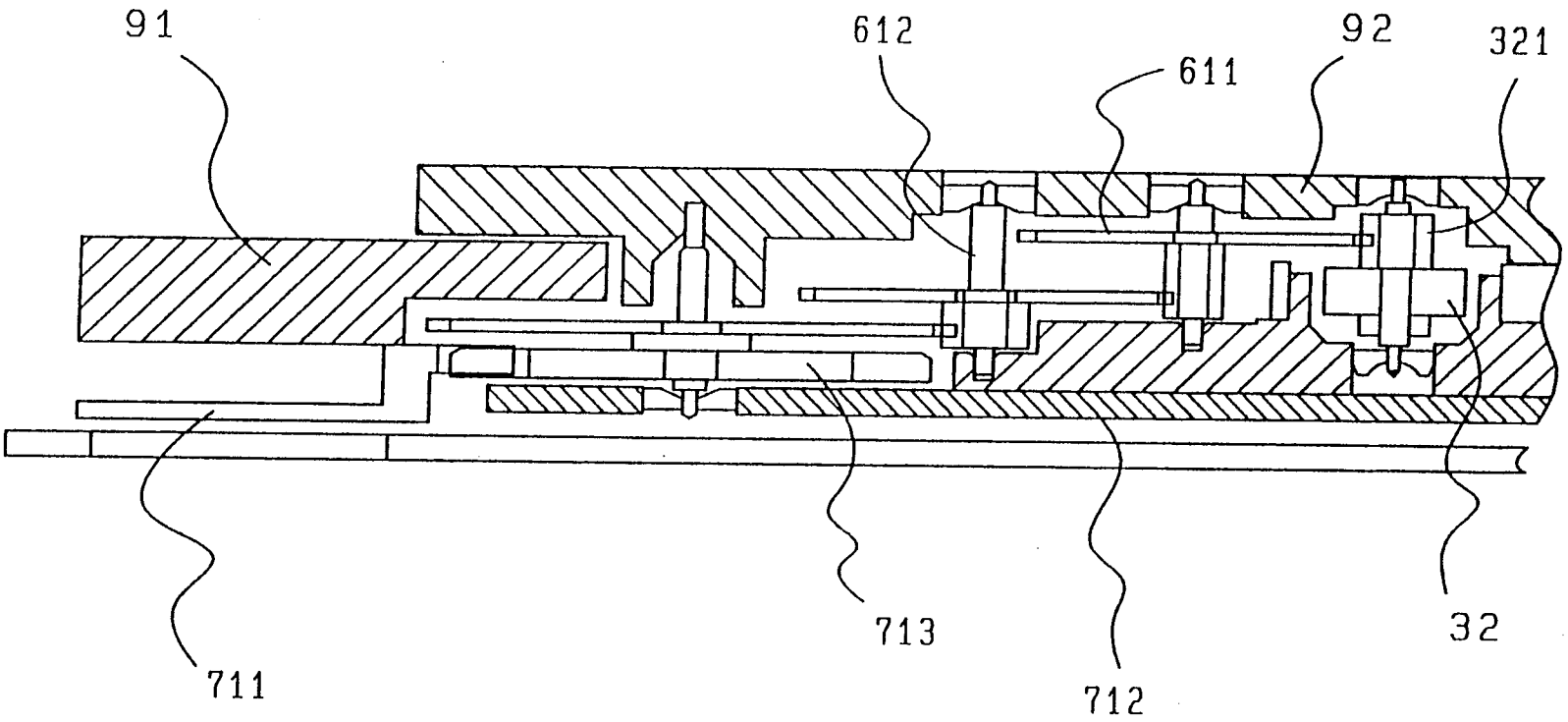
FIG. 22 PRIOR ART
FIG. 22 is a second longitudinal section view illustration a calendar indicating section of the prior art analog electronic timepiece.

FIGS. 13 and 14 show a third embodiment of the analog electronic timepiece of the present invention.

FIG. 13 shows an third embodiment in which a third ultrasonic motor 35 is provided as driving source for driving a chronograph indicating mechanism 73. The control circuit 245 controls generating timing of driving pulses of the first ultrasonic motor 34 for driving a time indicating mechanism 51 and driving pulses of the third ultrasonic motor 35 for driving the chronograph indicating mechanism 73. The control circuit 245 inputs a driving pulse command signal to a piezoelectric vibrator driving circuit 2461 for providing driving pulses to the first ultrasonic motor 34.

Here, in order to accelerate an electrostrictive effect of a piezoelectric vibrator 351 which structures the third ultrasonic motor 35, an ultrasonic signal of, for example, 20 KHz to 40 KHz needs to be carried on the driving pulse of the third ultrasonic motor 35. The electronic circuit 2 is provided with a driving pulse generating circuit 2463 for oscillating an ultrasonic signal of, for example, 20 KHz to 40 KHz. The ultrasonic signal is supplied to the piezoelectric vibrator driving circuit 2461 through the intermediary of an output pulse generating circuit 2462. The piezoelectric vibrator driving circuit 2461 combines the ultrasonic signal from the output pulse generating circuit 2462 with the driving pulse command signal of 1 Hz of the control circuit 235 to make the driving pulse of the third ultrasonic motor 35.

The driving pulse from the piezoelectric vibrator driving circuit 2461 induces the electrostrictive effect of the piezoelectric vibrator 351. The piezoelectric vibrator 351 vibrates and transmits the vibration to a vibrator 352. The vibrator 352 and a moving member 353 are pressurized and contacted by a pressurizing force of an elastic pressurizing spring 354.

Due to that, a frictional force is generated between the vibrator 342 and the moving member 343 by the vibration of the vibrator 342 and thereby the moving member 343 performs rotation movement. Due to the rotation of the moving member 343, the chronograph indicating mechanism 73 is driven. Control of the chronograph indicated by the chronograph indicating mechanism 73 is performed by a chronograph command inputting device 83.

In FIG. 14, the third ultrasonic motor 35 for driving the chronograph indicating mechanism 73 supplies the driving pulse transmitted from the electronic circuit 2 to the piezoelectric vibrator 351 of the third ultrasonic motor 35 to induce a high frequency vibration by the electrostrictive effect in the piezoelectric vibrator 351. The vibrator 352 is excited and vibrated by receiving the high frequency vibration of the piezoelectric vibrator 351.

The vibrator 352 and the moving member 353 are pressurized and contacted by a pressurizing spring 354, so that a frictional force is generated between the projections 3521 of the vibrator 352 for amplifying the vibration of the vibrator 352 and a sliding section 3531 of the moving member 353. The moving member 353 rotates centering on a shaft section 3533 of the moving member 353 which is engaged with the moving member guiding section 911 of the support member 91.

The moving member 353 is provided with an engage section 3534 of the moving member 353 which penetrates the support member 91 to fix a special indicator 504. Thereby, the special indicator 504 is driven by rotation of the moving member 353 and special functions such as chronograph function may be displayed. The use to the ultrasonic motor having high holding torque as a driving source of functions such as the chronograph function which is not always driven allows to eliminate erroneous operation and to display high reliable special functions without being influenced by outside shocks.

Further, since the special indicator 504 is directly fixed to the engaging section 3534 of the shaft section 3533 of the moving member 353 which is the driving source, an analog electronic timepiece in which the number of parts is allowed to reduce is realized. Still more, the reliability of the special functions such as the chronograph function may be enhanced by mounting the third ultrasonic motor 35 as the driving source for driving a pointer for indicating less than a second which needs not be always driven such as the chronograph function.

According to the present invention, the following effects is obtained:

1) A high reliable multi-function analog electronic timepiece is obtained.

2) A thin type analog electronic timepiece is obtained.

What is claimed is:

1. An analog electronic timepiece, comprising:

a power source;

a source oscillator which is operated by said power a source to output reference signals;

an ultrasonic motor driving circuit which receives the output signal from said source oscillator and outputs pulses of predetermined frequency for driving an vibration generating means;

said vibration generating means inducing vibration by electrostrictive effect of a piezoelectric element in accordance to the output signal from said ultrasonic motor driving circuit;

a pressurizing means for pressurizing said vibration generating means and a rotating means by a predetermined pressure;

said rotating means performing rotation motion by vibration of a vibrator;

a first indicating means which operates by rotation of said rotation of said rotating means;

a motor driving circuit for outputting output signal for driving a motor;

said motor operating in accordance to said output signal from said motor driving circuit; and a second indicating means which is operated by said motor.

2. An analog electronic timepiece, comprising:

a power source;

a source oscillator which is operated by said power source to output reference signals;

an ultrasonic motor driving circuit which receives the output signal from said source oscillator and outputs pulses of predetermined frequency for driving an vibration generating means;

a first vibration generating means for inducing vibration by electrostrictive effect of a piezoelectric element in accordance to the output signal from said ultrasonic motor driving circuit;

a first pressurizing means for pressurizing said first vibration generating means and a first rotating means by a predetermined pressure;

said first rotating means performing rotation motion by vibration of a first vibrator;

a first indicating means which operates by the rotation of said first rotating means;

a second vibration generating means for inducing vibration by electrostrictive effect of a piezoelectric element in accordance to the output signal from said ultrasonic motor driving circuit;

a second pressurizing means for pressurizing said second vibration generating means and a second rotating means by a predetermined pressure;

said second rotating means performing rotation motion by vibration of a second vibrator; and a second indicating means which operates by the rotation of said second rotating means.

3. The analog electronic timepiece as claimed in claim 1 wherein at least one of said first vibration generating means, said first rotating means and said first pressurizing means and at least one of said second vibration generating means, said second rotating means and said second pressurizing means are disposed by being piled each other.

4. An analog electronic timepiece, comprising:

a power source;

a source oscillator which is operated by said power source to output reference signals;

an ultrasonic motor driving circuit which receives the output signal from said source oscillator and outputs pulses of predetermined frequency for driving an vibration generating means;

a first vibration generating means for inducing vibration by electrostrictive effect of a piezoelectric element in accordance to the output signal from said ultrasonic motor driving circuit;

said first rotating means performing rotation motion by vibration of a first vibrator;

a first indicating means which operates by the rotation of said first rotating means;

a second vibration generating means for inducing vibration by electrostrictive effect of a piezoelectric element in accordance to the output signal from said ultrasonic motor driving circuit;

said second rotating means performing rotation motion by vibration of a second vibrator;

a second indicating means which operates by the rotation of said second rotating means; and a pressurizing means for pressurizing said first vibration generating means and said first rotating means, and for pressurizing said second vibration generating means and said second rotating means.

* * * * *